US012054906B2

(12) United States Patent
Hubbard

(10) Patent No.: US 12,054,906 B2
(45) Date of Patent: Aug. 6, 2024

(54) UNDERFLOOR STORAGE VAULT

(71) Applicant: Atlas Survival Shelters LLC, Sulphur Springs, TX (US)

(72) Inventor: Ronal Hubbard, Sulphur Springs, TX (US)

(73) Assignee: Atlas Survival Shelters LLC, Sulphur Springs, TX (US)

( * ) Notice: Subject to any disclaimer, the term of this patent is extended or adjusted under 35 U.S.C. 154(b) by 421 days.

(21) Appl. No.: 17/401,037

(22) Filed: Aug. 12, 2021

(65) Prior Publication Data

US 2023/0049236 A1 Feb. 16, 2023

(51) Int. Cl.
*E02D 29/12* (2006.01)
*E02D 29/045* (2006.01)
*E02D 29/14* (2006.01)

(52) U.S. Cl.
CPC ..... *E02D 29/122* (2013.01); *E02D 29/045* (2013.01); *E02D 29/127* (2013.01); *E02D 29/14* (2013.01)

(58) Field of Classification Search
CPC ... E02D 29/122; E02D 29/045; E02D 29/127; E02D 29/14; E02D 29/12; E03F 5/02; E04H 9/12; E04H 9/10; E04H 9/14
See application file for complete search history.

(56) References Cited

U.S. PATENT DOCUMENTS 541,987 A * 7/1895 Whiteside ..... E02D 29/12 52/270
1,343,642 A 6/1920 Henry
1,580,541 A 4/1926 Sherman
3,196,813 A 7/1965 Mchugh
3,251,159 A 5/1966 Trice
3,715,958 A * 2/1973 Crawford ..... E02D 29/124 52/21
4,534,144 A 8/1985 Gustafsson et al.
5,655,338 A 8/1997 Lucas
6,131,343 A 10/2000 Jackson, Jr.
6,385,919 B1 5/2002 McCarthy
6,385,920 B1 5/2002 Chandler
(Continued)

FOREIGN PATENT DOCUMENTS

GB 612848 A 11/1948
JP H09189039 A 7/1997

OTHER PUBLICATIONS

Atlas Survival Shelters; "Incredible Secret Rooms and Tricked Out Bomb Shelters"; Oct. 7, 2018; URL: https://www.youtube.com/watch?v=ptvA5R456ro.

(Continued)

*Primary Examiner* — Patrick J Maestri
(74) *Attorney, Agent, or Firm* — James H. Ortega; Carstens, Allen & Gourley, LLP

(57) ABSTRACT

An underground storage vault having a hatch affixed to a hatchway. The underfloor storage vault may be incorporated into a larger structure such that the surface of the vault's hatch may be flush with the surrounding floor, allowing for the hatch to be easily concealed. Once the concealment has been removed, fasteners can be undone so that the hatch can be removed from inhibiting access to the hatchway. Valuables and possessions can be stored in the vaults storage compartment and safely secured by re-affixing the hatch to the vault's hatchway.

20 Claims, 14 Drawing Sheets

(56) References Cited

U.S. PATENT DOCUMENTS

| | | | | |
|---|---|---|---|---|
| 8,596,018 | B2 | 12/2013 | Dagher et al. | |
| 9,010,230 | B2 | 4/2015 | Peters | |
| 9,279,265 | B1 | 3/2016 | Nead | |
| 10,428,541 | B2 | 10/2019 | Harve et al. | |
| 10,961,681 | B2 * | 3/2021 | Friesen | E02D 29/127 |
| 10,968,594 | B1 * | 4/2021 | Friesen | E02D 29/128 |
| 2004/0231918 | A1 | 11/2004 | Meeker | |
| 2009/0084793 | A1 * | 4/2009 | Anderson | B28B 21/28 264/312 |
| 2011/0023759 | A1 | 2/2011 | Waller | |
| 2012/0009020 | A1 * | 1/2012 | Kiest, Jr. | E04B 1/66 405/150.1 |
| 2012/0180425 | A1 | 7/2012 | Dooley et al. | |
| 2016/0258191 | A1 * | 9/2016 | Zeloof | E05B 35/008 |
| 2017/0219316 | A1 | 8/2017 | Peters | |
| 2019/0360167 | A1 * | 11/2019 | Turner | E02D 29/14 |

OTHER PUBLICATIONS

Atlas Survival Shelters; "Installing & Testing The Escape Tunnel On an ATLAS Bomb Shelter"; Dec. 7, 2018; URL: https://www.youtube.com/watch?v=bmqRF67hURA.

Atlas Survival Shelters; "Installing a $500,000 Luxury Platinum Series Doomsday Bunker in Minnesota"; Jun. 15, 2021; URL: https://www.youtube.com/watch?v=KoctrlEc3Us.

Atlas Survival Shelters; "Installing a Bomb Shelter in South Dakota"; Aug. 24, 2019; URL: https://www.youtube.com/watch?v=3sN7efVDEaU.

Atlas Survival Shelters; "Installing a Wildfire Bunker"; Sep. 3, 2019; URL: https://www.youtube.com/watch?v=sNWdQqYSDkc.

Atlas Survival Shelters; "Building a $300,000 Big Boy Bomb Shelter—Part 1"; Jul. 16, 2021; URL: https://www.youtube.com/watch?v=K1HF-83mQ8s.

Atlas Survival Shelters; "Building a $300,000 Big Boy Modular Bomb Shelter—Part 2"; Jul. 31, 2021; URL: https://www.youtube.com/watch?v=tIYI21zm1DQ.

Atlas Survival Shelters; "Building the Big Boy 12'×48' Bunker—Stage 1—Floor and Paint"; Jan. 20, 2020; URL: https://www.youtube.com/watch?v=8f0Cep-OTVU.

Atlas Survival Shelters; "Bunker In My Backyard—The Atlas 10×21 Culvert Shelter"; Sep. 15, 2018; URL: https://www.youtube.com/watch?v=jRHbtEiVVgk.

Atlas Survival Shelters; "Catalog—The Future of Bomb Shelters," URL: https://www.atlassurvivalshelters.com; 20 pages.

Atlas Survival Shelters; "Final Inspection Video of an Atlas Bunker Before It Ships"; Mar. 11, 2019; URL: https://www.youtube.com/watch?v=kN1yIQdSVbM.

Atlas Survival Shelters; "Finishing out a $500,000 Luxury Platinum Series Doomsday Bunker"; Jun. 18, 2021; URL: https://www.youtube.com/watch?v=TvwRIzzGZ5Y.

Atlas Survival Shelters; "Generator Pod—10×51 Round Culvert"; May 21, 2014; URL: https://www.youtube.com/watch?v=1Fe30aligo.

Atlas Survival Shelters; "Generator Pod—Atlas Survival Shelters"; Feb. 17, 2014; URL: https://www.youtube.com/watch?v=8yRLWSrbAk.

Atlas Survival Shelters; "Generator Pod Attached to 10×51 Round Culvert"; May 21, 2014; URL: https://www.youtube.com/watch?v=qN5EkcMLVps.

Atlas Survival Shelters; "Heavy Duty Modular Bomb Shelter Build"; Feb. 3, 2020; URL: https://www.youtube.com/watch?v=GwWmuXd6hpw.

Atlas Survival Shelters; "10×20 Round Culvert—The Backyard Bunker"; Aug. 7, 2017; URL: https://www.youtube.com/watch?v=vSYHKA88Co4.

Atlas Survival Shelters; "10×36 Round Culvert—Badass 6 Person Shelter"; Jul. 17, 2017; URL: https://www.youtube.com/watch?v=drbNC7NMNXs.

Atlas Survival Shelters; "10×51 Round Culvert—8 Person + Huge Master"; Aug. 2, 2017; URL: https://www.youtube.com/watch?v=lodqGdwno2E.

Atlas Survival Shelters; "10×51 Round Culvert—8 Person 2 Bedroom"; Oct. 31, 2013; URL: https://www.youtube.com/watch?v=G0iNaWAC2LQ.

Atlas Survival Shelters; "A $200,000 Luxury Bomb Shelter Under a Home—Atlas 10×40' Platinum Series Safe Cellar"; Sep. 7, 2020; URL: https://www.youtube.com/watch?v=CLGCdj7uzFs.

Atlas Survival Shelters; "A Tiny House Underground Bunker You Can Live In—Atlas 10×40' Modular"; Aug. 4, 2020; URL: https://www.youtube.com/watch?v=6-rrK7S45d0.

Atlas Survival Shelters; "Affordable $15000 Doomsday Cache Shelter Built and Delivered"; May 18, 2020; URL: https://www.youtube.com/watch?v=qpJR_59srVg.

Atlas Survival Shelters; "Are you looking for a Safe Room? Atlas Safe Cellar should be your Plan B"; Jan. 15, 2021; URL: https://www.youtube.com/watch?v=SKRONoERLS0.

Atlas Survival Shelters; "Atlas 10×30 Safe-Cellar—Luxury Bunker Built Under A Home (Complete Installation Video)—Part 1"; Sep. 13, 2018; URL: https://www.youtube.com/watch?v=x4NU9KwpZog.

Atlas Survival Shelters; "Atlas 10×35 Culvert with French Drain (Complete Install)"; Dec. 7, 2020; URL: https://www.youtube.com/watch?v=x9PqYB1QQ9k.

Atlas Survival Shelters; "Atlas 10'×38' Round Water Tight Bomb Shelter !!"; May 23, 2020; URL: https://www.youtube.com/watch?v=0fTCHYiixw8.

Atlas Survival Shelters; "Atlas 10×40 Safe Cellar on Shipping Day"; Aug. 13, 2020; URL: https://www.youtube.com/watch?v=Rlc_RlgWvGs.

Atlas Survival Shelters; "Atlas 12×20 Safe Cellar—Doomsday bunker under a driveway"; Jul. 2, 2021; URL: https://www.youtube.com/watch?v=20wywMobYBE&t=4s.

Atlas Survival Shelters; "Atlas Dome Bunkers "How to Live Underground in style !!""; Jun. 10, 2020; URL: https://www.youtube.com/watch?v=TvII9GI9g4k.

Atlas Survival Shelters; "Atlas Dome Shelters"; Aug. 28, 2013; URL: https://www.youtube.com/watch?v=ou1ISorkDzM.

Atlas Survival Shelters; "Atlas stands behind its products—Repair of an Escape Tunnel"; Mar. 4, 2020; URL: https:// www.youtube.com/watch?v=uwsfkCe1v1o.

Atlas Survival Shelters; "Atlas Survival Shelters—10'×51' Home"; May 8, 2013; URL: https://www.youtube.com/watch?v=2tSUYSWy9fY.

Atlas Survival Shelters; "Atlas Survival Shelters—under floor storage"; May 8, 2013; URL: https://www.youtube.com/watch?v=6jrUHnpMZQQ.

Atlas Survival Shelters; "Atlas Survival Shelters 10'×51' Hillside Retreat"; Mar. 21, 2013; URL: https://www.youtube.com/watch?v=nBcfYwU4rVs.

Atlas Survival Shelters; "Bad Rising S Bunker floods and destroys $100,000 in survival food"; Nov. 5, 2019; URL: https://www.youtube.com/watch?v=L7ktaNJe8ew.

Atlas Survival Shelters; "Barn-dominium Bunker Installation—Atlas 10×26' Culvert w/ Generator Pod"; Dec. 29, 2020; URL: youtube.com/watch?v=wIQc0Pv-SAc.

Atlas Survival Shelters; "Big Boy Bomb Shelter finally revealed!"; Apr. 4, 2020; URL: https://www.youtube.com/watch?v=YK0TU0fknmE.

Atlas Survival Shelters; "Big Boy Bomb Shelter is where I'm spending the Corona Virus Quarantine."; Mar. 31, 2020; URL: https://www.youtube.com/watch?v=SB6zt3dIDmA.

Atlas Survival Shelters; "Big Boy Bunker Gets Installed (Detailed Instructions)"; Nov. 24, 2020; URL: https://www.youtube.com/watch?v=7TeEV7ag79I.

Atlas Survival Shelters; "The Best Shipping Container Shelter Ever"; Aug. 27, 2013; URL: https://www.youtube.com/watch?v=vjn2K6NHYHs.

Atlas Survival Shelters; "The Doomsday Prepper's Bunker We Did For TV In 2012—Then & Now !"; Nov. 29, 2018; URL: https://www.youtube.com/watch?v=w5bQc5Z9cmo.

(56) References Cited

OTHER PUBLICATIONS

Atlas Survival Shelters; "The first Atlas Bunker built in our European Factory"; Jun. 5, 2021; URL: https://www.youtube.com/watch?v=tzRKWc4-tMs.
Atlas Survival Shelters; "The Good News About Nuclear Destruction"; Aug. 24, 2020; URL: https://www.youtube.com/watch?v=WprJQ7WYdJY.
Atlas Survival Shelters; "This $130,000 Bomb Shelter is Huge inside."; Apr. 12, 2020; URL: https://www.youtube.com/watch?v=1i88f4IExUE.
Atlas Survival Shelters; "This $150,000 Bomb Shelter is Nice Inside!—Atlas 10×33 with Generator Pod"; Jan. 3, 2020; URL: https://www.youtube.com/watch?v=5xN9hJLNz9E.
Atlas Survival Shelters; "This $50,000 Wine Cellar is Really a Secret Bomb Shelter"; Feb. 16, 2020; URL: https://www.youtube.com/watch?v=So8LFOec32Y.
Atlas Survival Shelters; "This $70,000 Ammo Bunker makes a great Pew Pew Vault"; Oct. 22, 2020; URL: https://www.youtube.com/watch?v=gy-QEKx7ORw.
Atlas Survival Shelters; "This $70,000 Doomsday Bunker Was Made to Withstand an Earthquake!!"; May 27, 2020; URL: https://www.youtube.com/watch?v=RZMuBQxWvHQ.
Atlas Survival Shelters; "Tiny Homes and Cottages for your Underground Bunker Part 1"; Jun. 22, 2019; URL: https://www.youtube.com/watch?v=j2iuTJysH5A.
Atlas Survival Shelters; "Top 25 Things to Look For When buying a Bomb Shelter"; Jul. 22, 2020; URL: https://www.youtube.com/watch?v=9Q1pFN-sZw8.
Atlas Survival Shelters; "Top Ways to Bury Your Guns Before They Are Confiscated"; Jan. 14, 2021; URL: https://www.youtube.com/watch?v=tZ7KTSPum-Y.
Atlas Survival Shelters; "Walk through 10 bunkers in 10 minutes—what you missed at the prepper show!"; Oct. 7, 2019; URL: https://www.youtube.com/watch?v=gqhwszmBm6w.
Atlas Survival Shelters; "We make Bomb Shelters that look like Homes inside how we do it"; Apr. 1, 2021; URL: https://www.youtube.com/watch?v=vckGd79dJfw.
Atlas Survival Shelters; "World's Largest Bomb Shelter Factory"; Oct. 11, 2018; URL: https://www.youtube.com/watch?v=U_LD2m_AL3Q.

* cited by examiner

UNDERFLOOR STORAGE VAULT

BACKGROUND

Technical Field

The present disclosure relates to a container for securing possessions. More particularly, and not by way of limitation, the present disclosure is directed to a vault that can be located under the floor or ground that allows for secure storage of possessions.

Background

This background section is intended to provide a discussion of related aspects of the art that could be helpful to understanding the examples discussed in this disclosure. It is not intended that anything contained herein be an admission of what is or is not prior art, and accordingly, this section should be considered in that light.

Having an easy to conceal and secure compartment under the floor of a structure such as a house would be ideal for any individual looking to protect possessions and valuables and keep them well hidden. There are many options available to an individual seeking to store valuables for safe keeping. Small items such as jewelry or important documents could be placed in a safety deposit box. However, this requires leaving the items at a location controlled by a third party and, generally, the boxes are not very big. Larger items would require more room and may not be offered or financially feasible for individuals in more rural or remote locations. Further, retrieving the items requires time and travelling great distances to the location of the safety deposit box so immediate retrieval is not possible.

Safes can place placed in the individual's home. A safe or a strong box remedies the issue of travel time and impediments to retrieving the item by having to be processed through security at the location of the safety deposit box. But safes would also be a prime target for potential thieves. The smaller the safe was, the easier it would be for a thieve to compromise its integrity or simply transport it away to be broken into at the thief's convenience. Individuals can conceal strong boxes and safes, however, space restrictions and accessibility can undermine the benefits of having a safe in a building or home.

Another option is to build a room(s) under the ground to store possessions in. Storage space would only be limited by how big the room(s) were constructed. Retrieval could be immediate. Having the room constructed into a building or a home, however, would make it much harder to hid or disguise. The ability to security properly would also be heavily determined by how much the person seeking to store their items wanted to spend. Individuals without a substantial number of resources would not be able to build an additional room to store their possessions.

What is needed is an underfloor storage vault that allows for quick access, security, easy concealment, and adequate space, all while being affordable. It would be advantageous to have an underfloor storage vault that overcomes the disadvantages of the prior art. The present disclosure provides such a system and method.

BRIEF SUMMARY

This summary provides a discussion of aspects of certain examples of the invention. It is not intended to limit the claimed invention or any of the terms in the claims. The summary provides some aspects but there are aspects and examples of the invention that are not discussed here.

The present disclosure includes a storage vault that can be located under the floor of a house. During construction of a structure, or during a remodel of an existing structure, the underfloor storage vault can be located so that the surface of the hatch is level and flush with the surrounding floor. Braces attached on the sides of the hatchway allow for the storage vault to be secured by rods such as rebar. Then, the supporting foundation may be poured around the vault, properly securing it. Because the surface of the hatch is flush with the surrounding floor, the hatch can be easily disguised. To access the underfloor storage vault, the bolts that secure the hatch to the hatchway can be loosened and removed. Once all fasteners have been removed, the hatch can be opened to allow access to the storage compartment underneath. The fasteners may have specialized receiving pockets that allow for only insertion tools with a specialized matching insertion end to be properly seated, thereby limiting access to the internal compartment to only those that possess the matching insertion tool.

BRIEF DESCRIPTION OF THE DRAWINGS

The novel features believed characteristic of the disclosure are set forth in the appended claims. The disclosure itself, however, as well as a preferred mode of use, further objectives and advantages thereof, will be best understood by reference to the following detailed description of illustrative examples when read in conjunction with the accompanying drawings, wherein:

FIG. IN is a side cross-section view of the hatch for an example of the underfloor storage vault.

FIG. 1O is a close-up perspective from the top of the hatch properly seated in the indention of the hatchway.

Figure 1A:
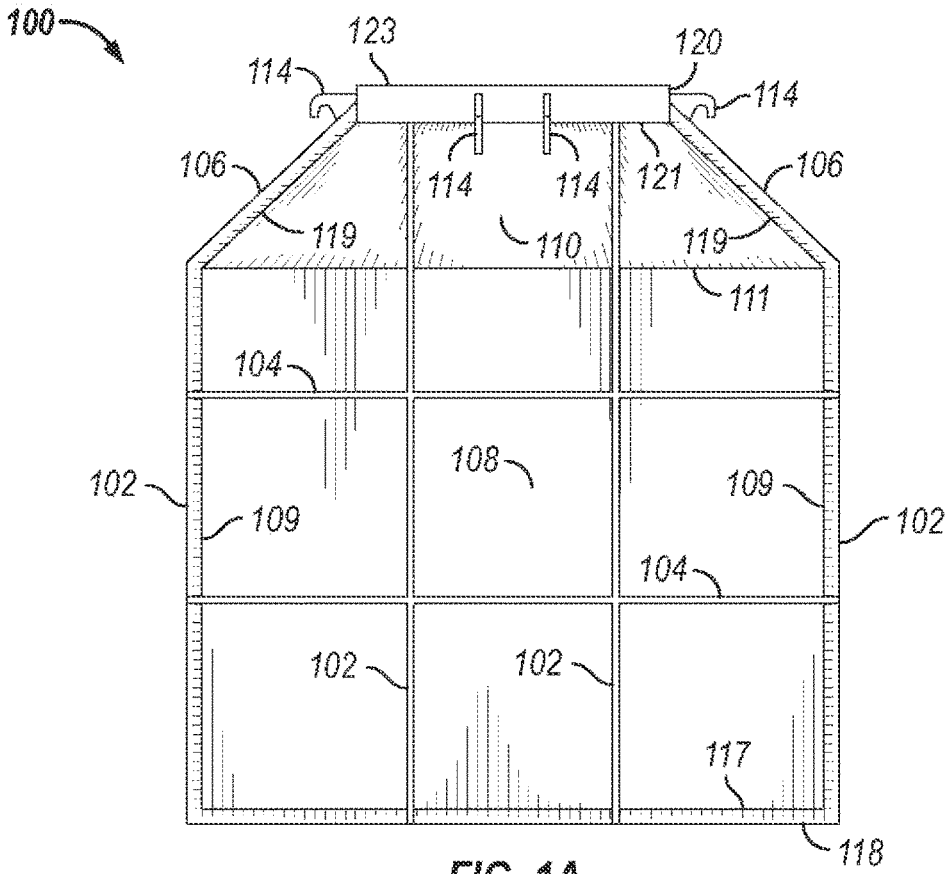
FIG. 1A is a front view of an example of the underfloor storage vault.
Figure 1B:
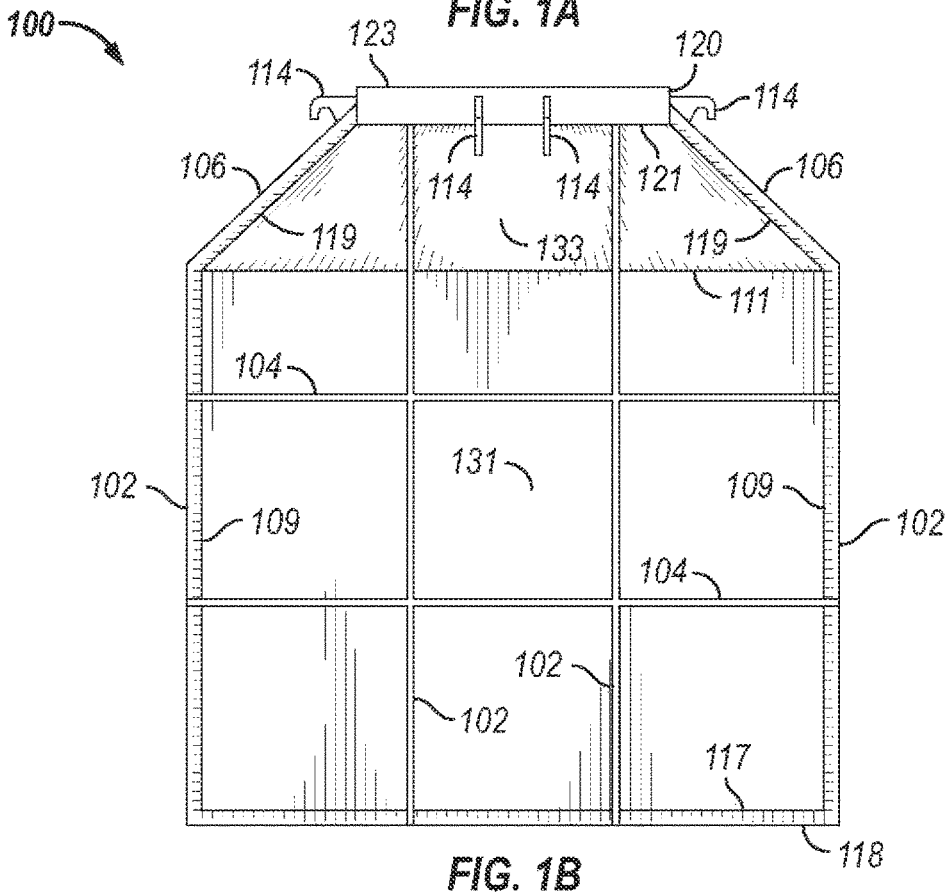
FIG. 1B is a left-side view of an example of the underfloor storage vault.
Figure 1C:
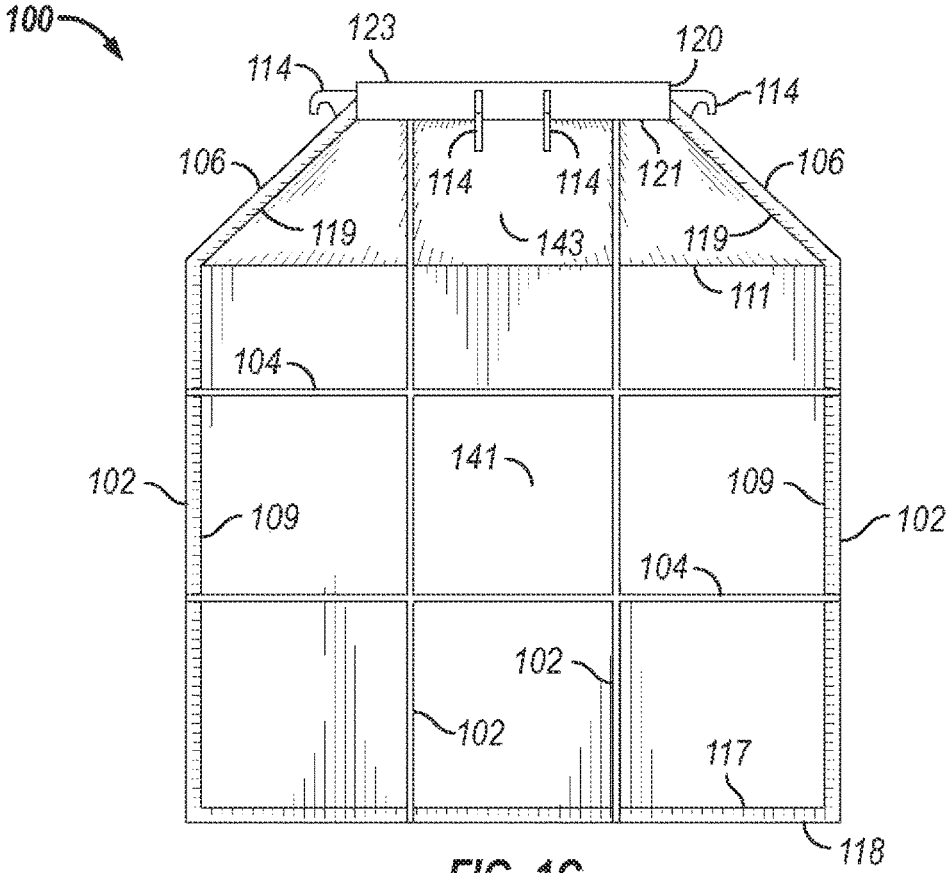
FIG. 1C is a right-side view of an example of the underfloor storage vault.
Figure 1D:
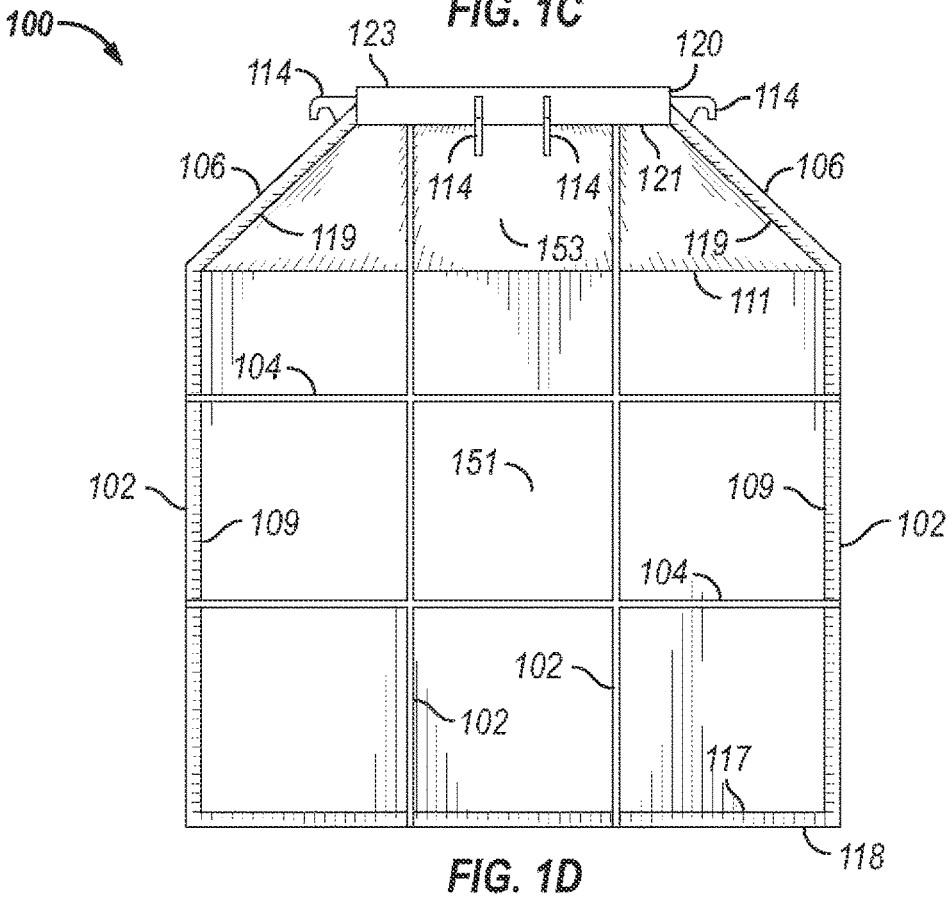
FIG. 1D is a rear view of an example of the underfloor storage vault.
Figure 1E:
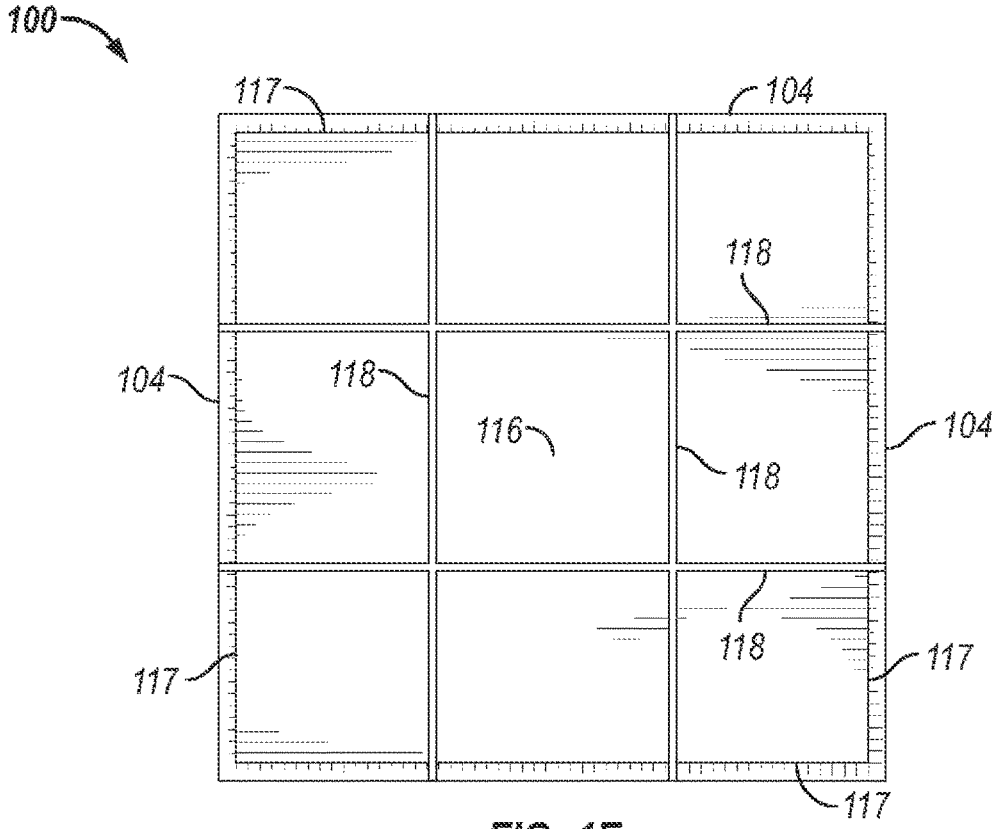
FIG. 1E is an underneath view of an example of the underfloor storage vault.
Figure 1F:
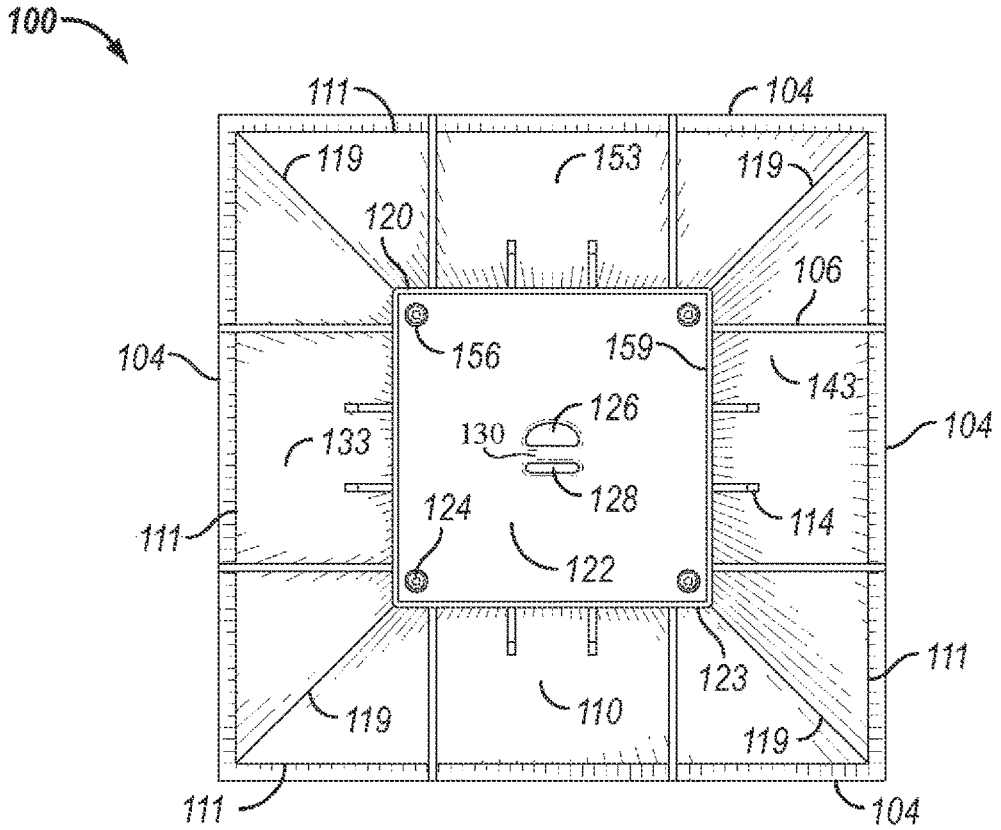
FIG. 1F is a top view of an example of the underfloor storage vault with hatch affixed.
Figure 1G:
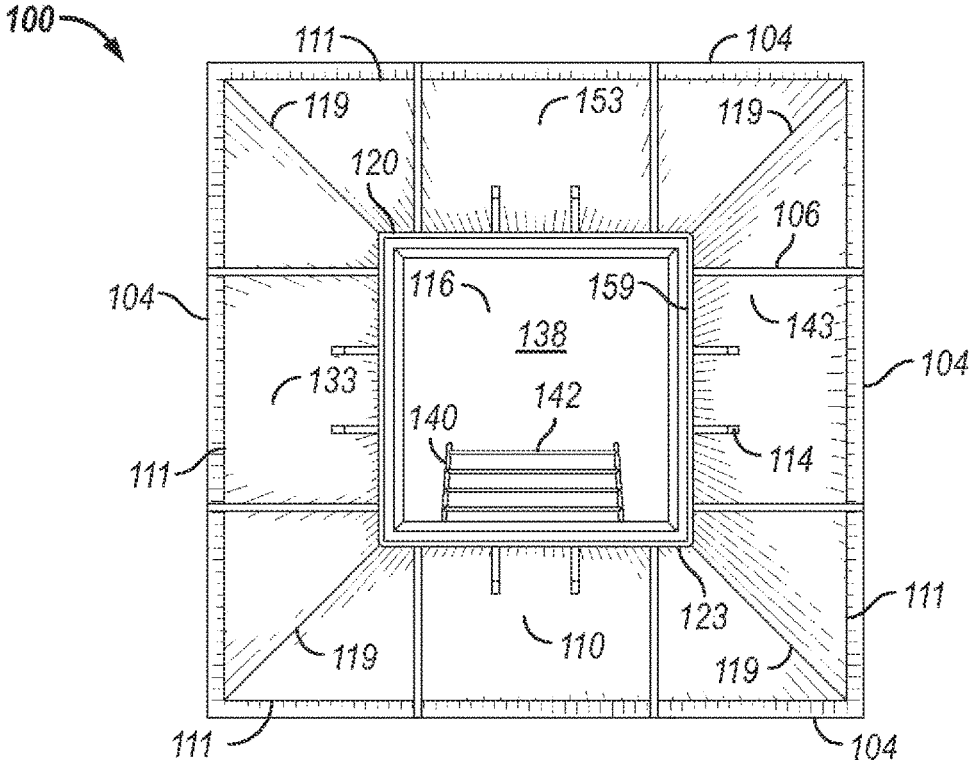
FIG. 1G is a top view of an example of the underfloor storage vault without hatch affixed.
Figure 1H:
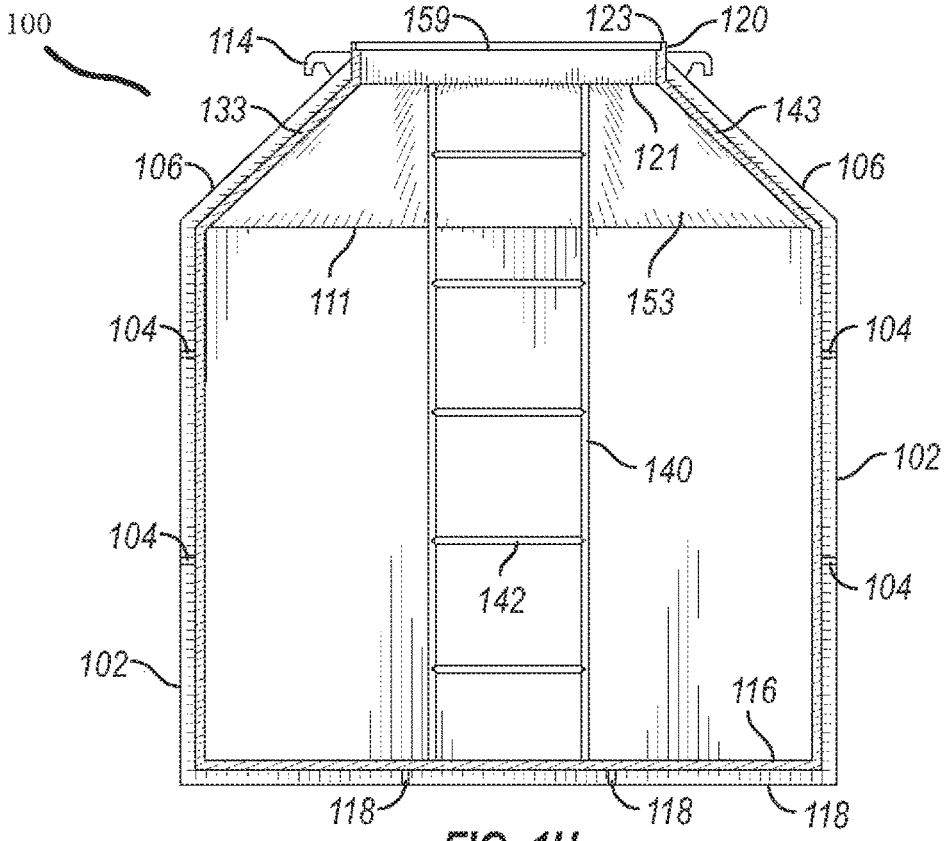
FIG. 1H is a cross-section front view of an example of the underfloor storage vault.
Figure 1I:
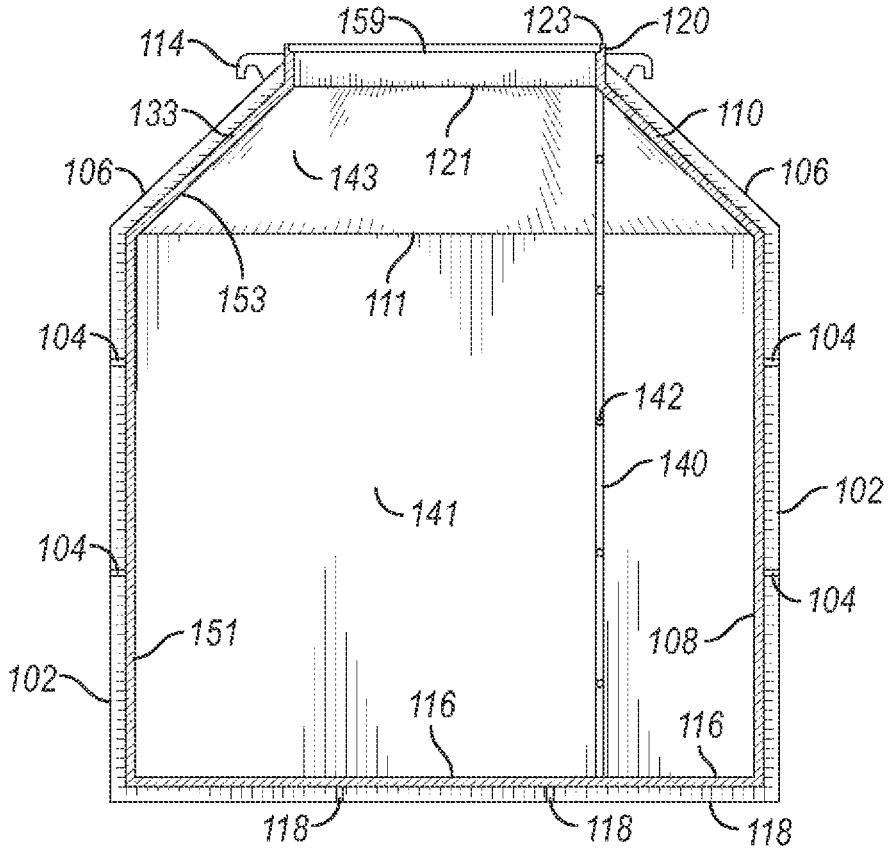
FIG. 1I is a cross-section side view of an example of the underfloor storage vault.
Figure 1J:
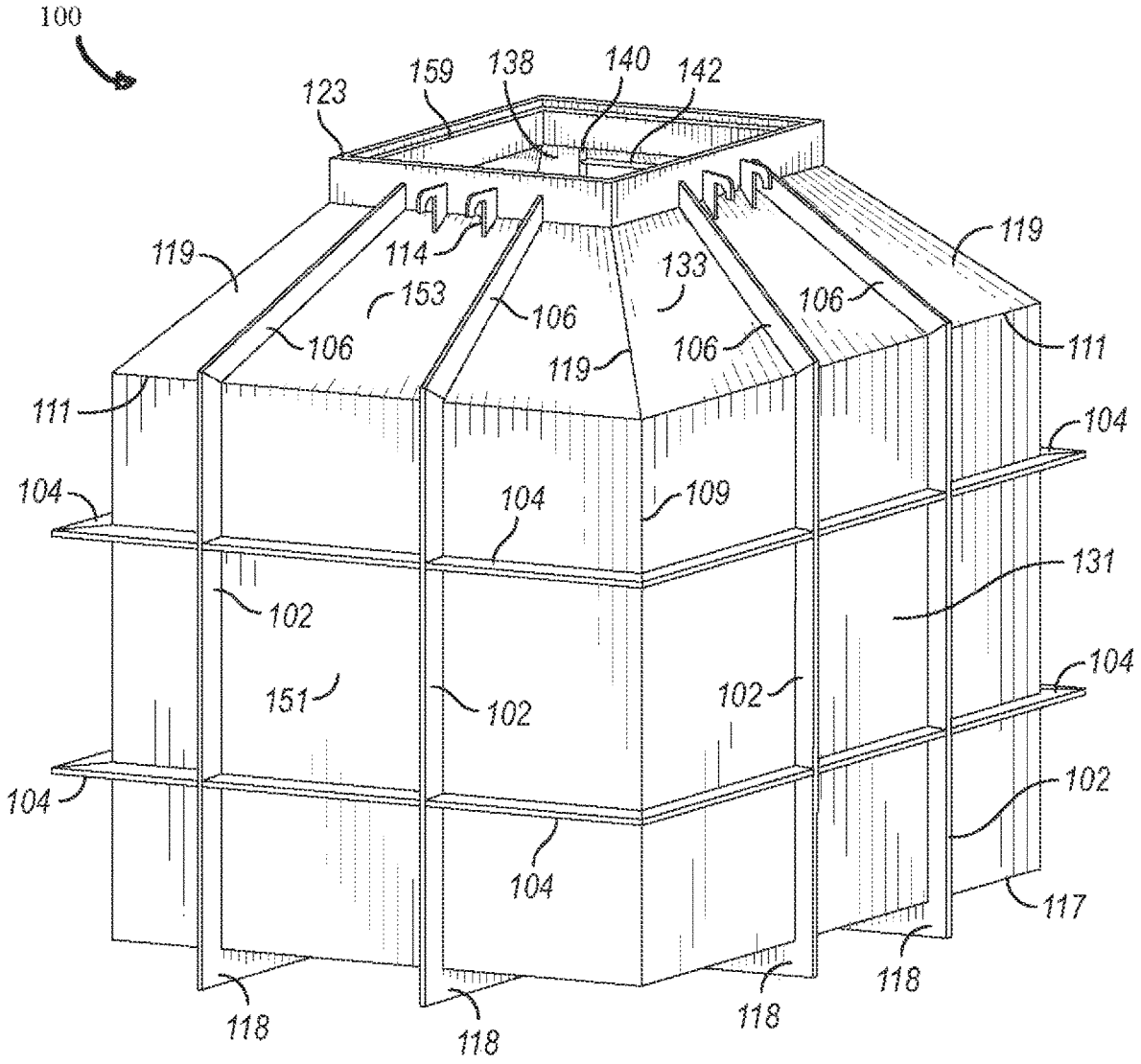
FIG. 1J is a perspective view from the top of an example of the underfloor storage vault.
Figure 1K:
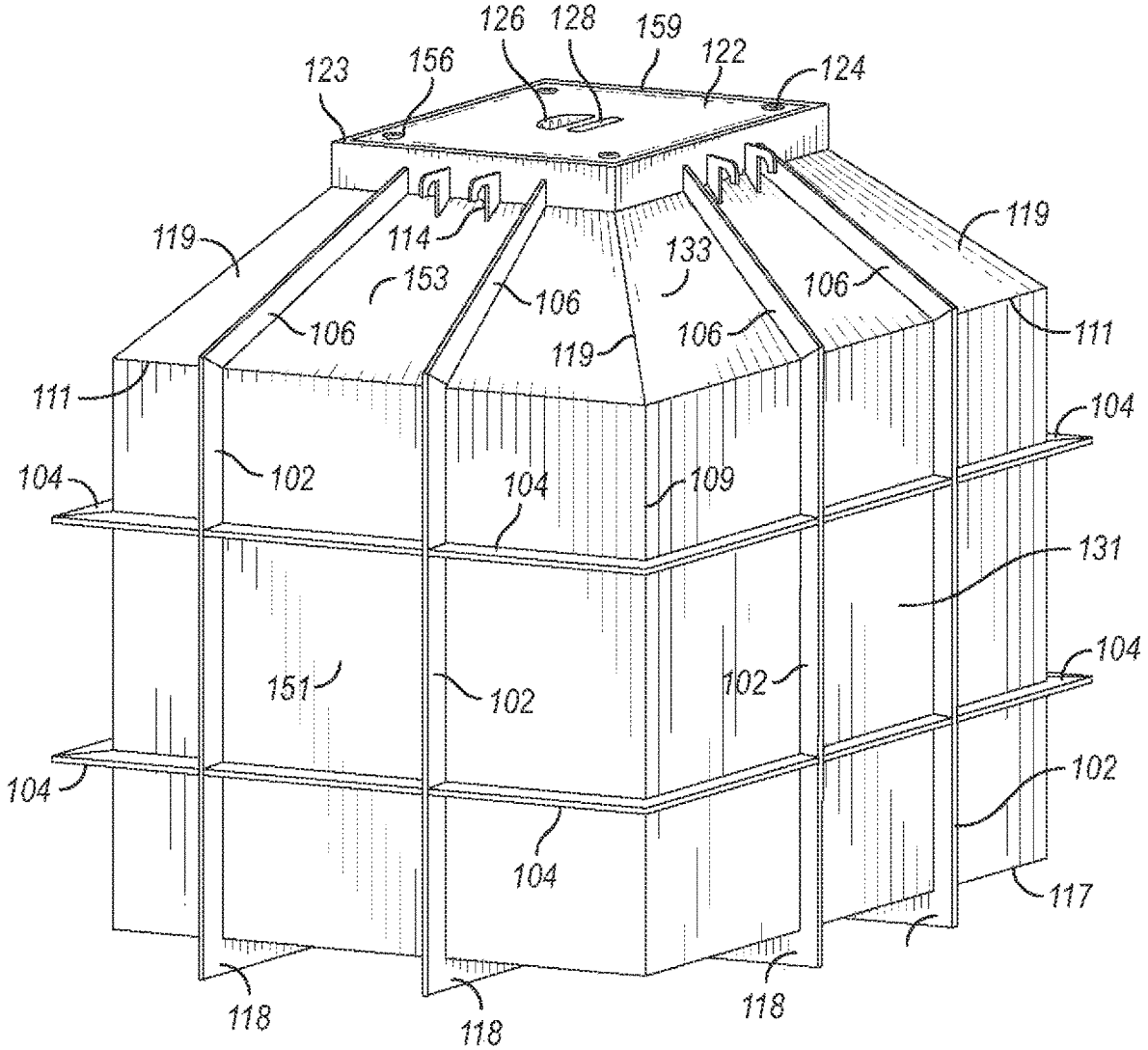
FIG. 1K is a perspective view from the top of top of an example of the underfloor storage vault with hatch affixed.
Figure 1L:
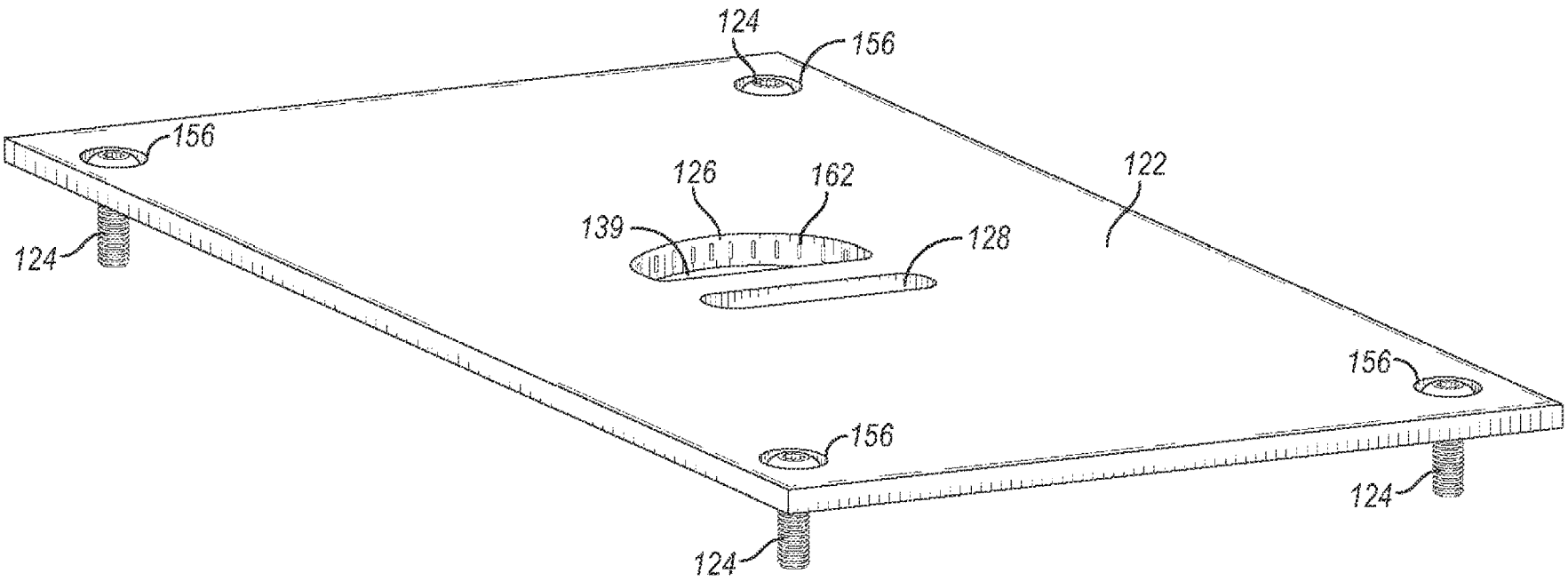
FIG. 1L is a close-up perspective from the top of the hatch for an example of the underfloor storage vault.
Figure 1M:
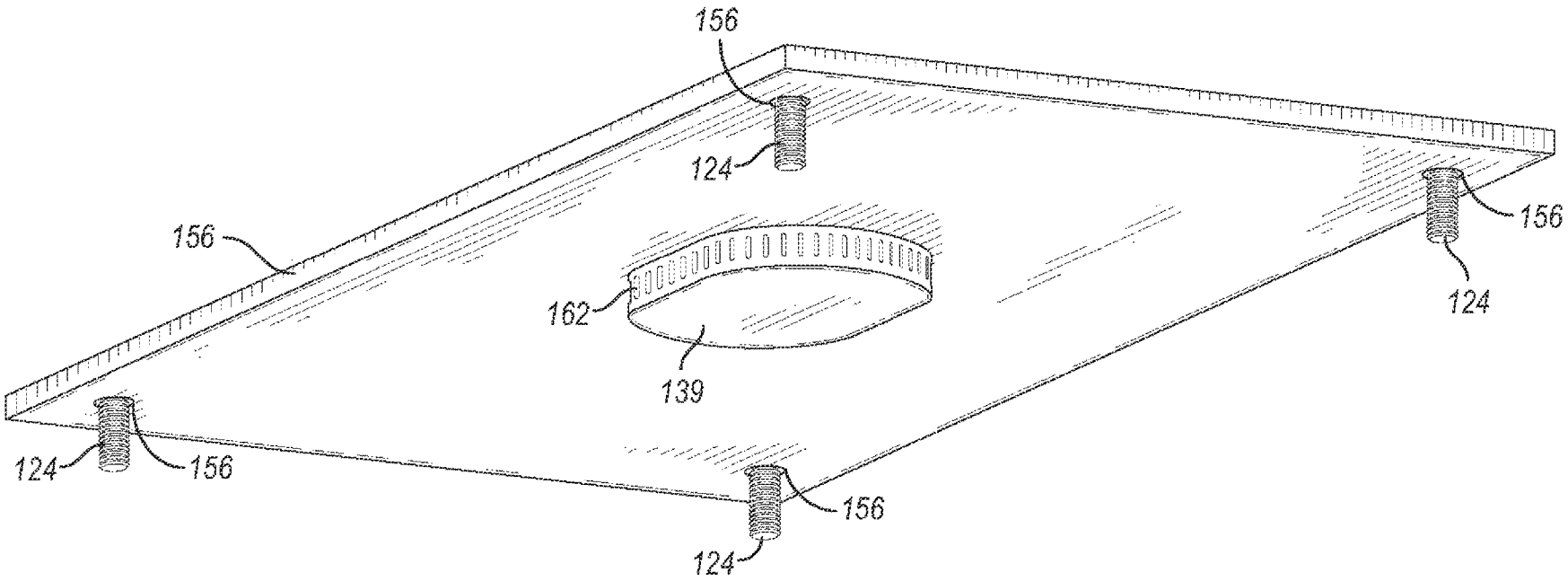
FIG. 1M is a close-up perspective from the bottom of the hatch for an example of the underfloor storage vault.
Figure 1N:
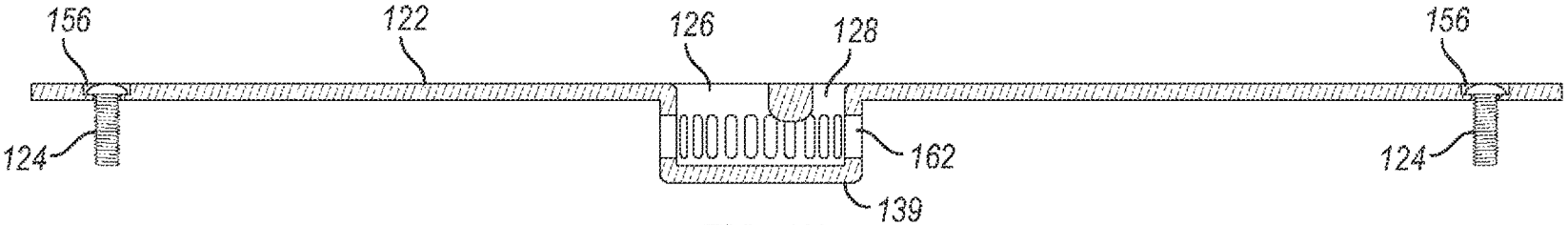
Figure 10:
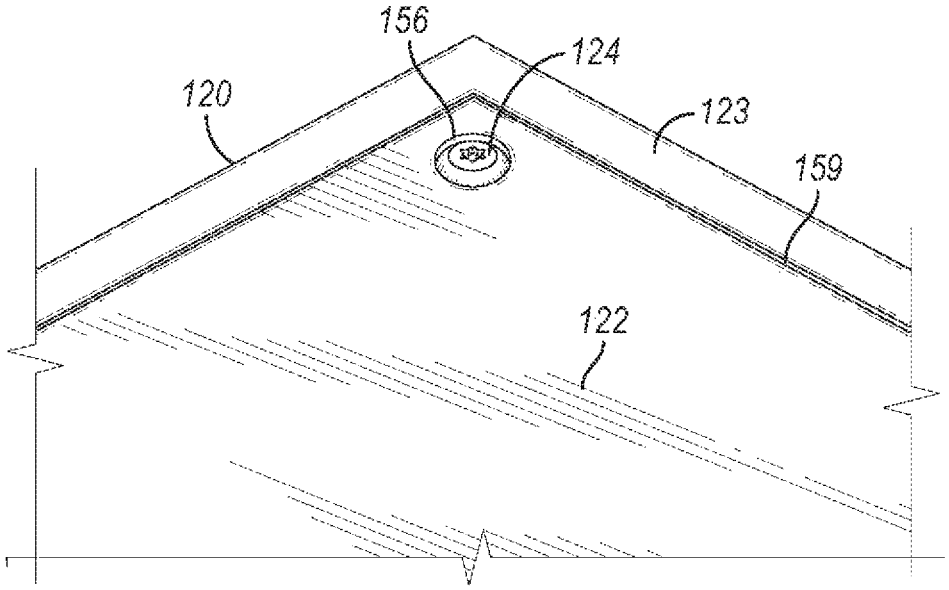
Figure 1P:
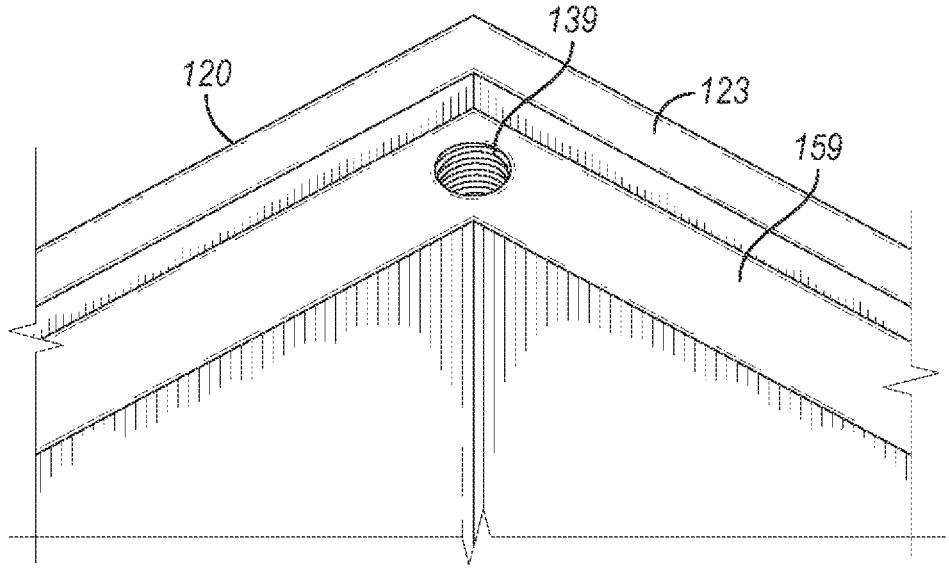

FIG. 1P is a close-up perspective from the top of the in the indention on the hatchway.

Figure 2A:
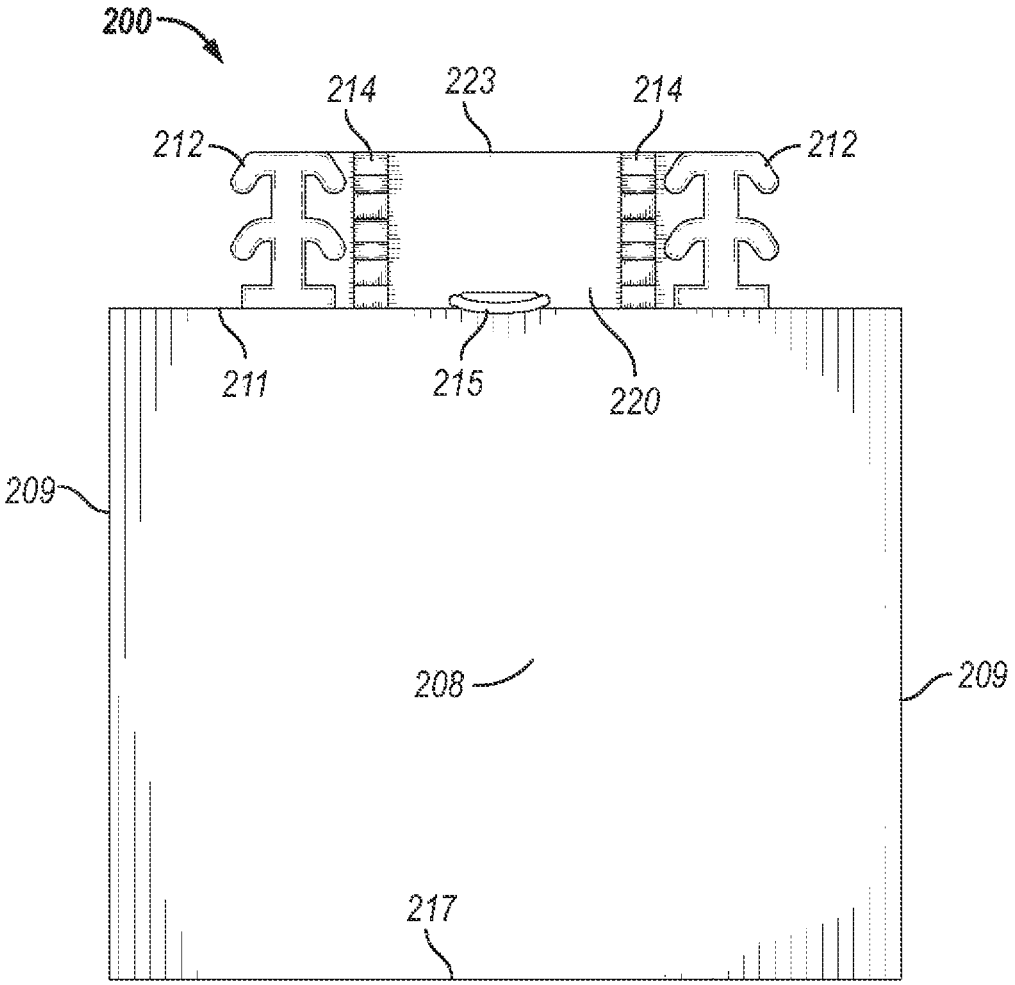

FIG. 2A is a front view of an example of the underfloor storage vault.

Figure 2B:
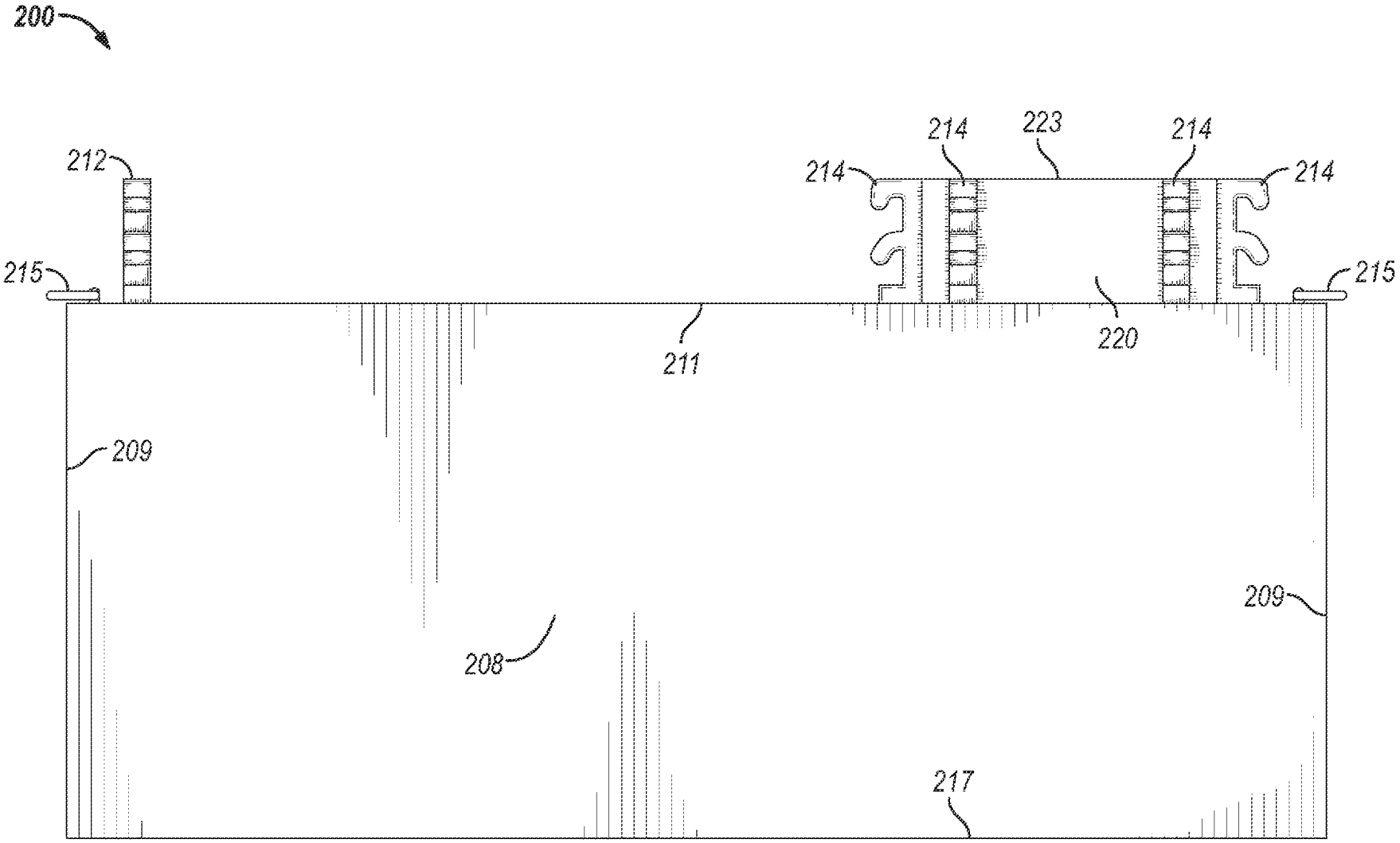

FIG. 2B is a left-side view of an example of the underfloor storage vault.

Figure 2C:
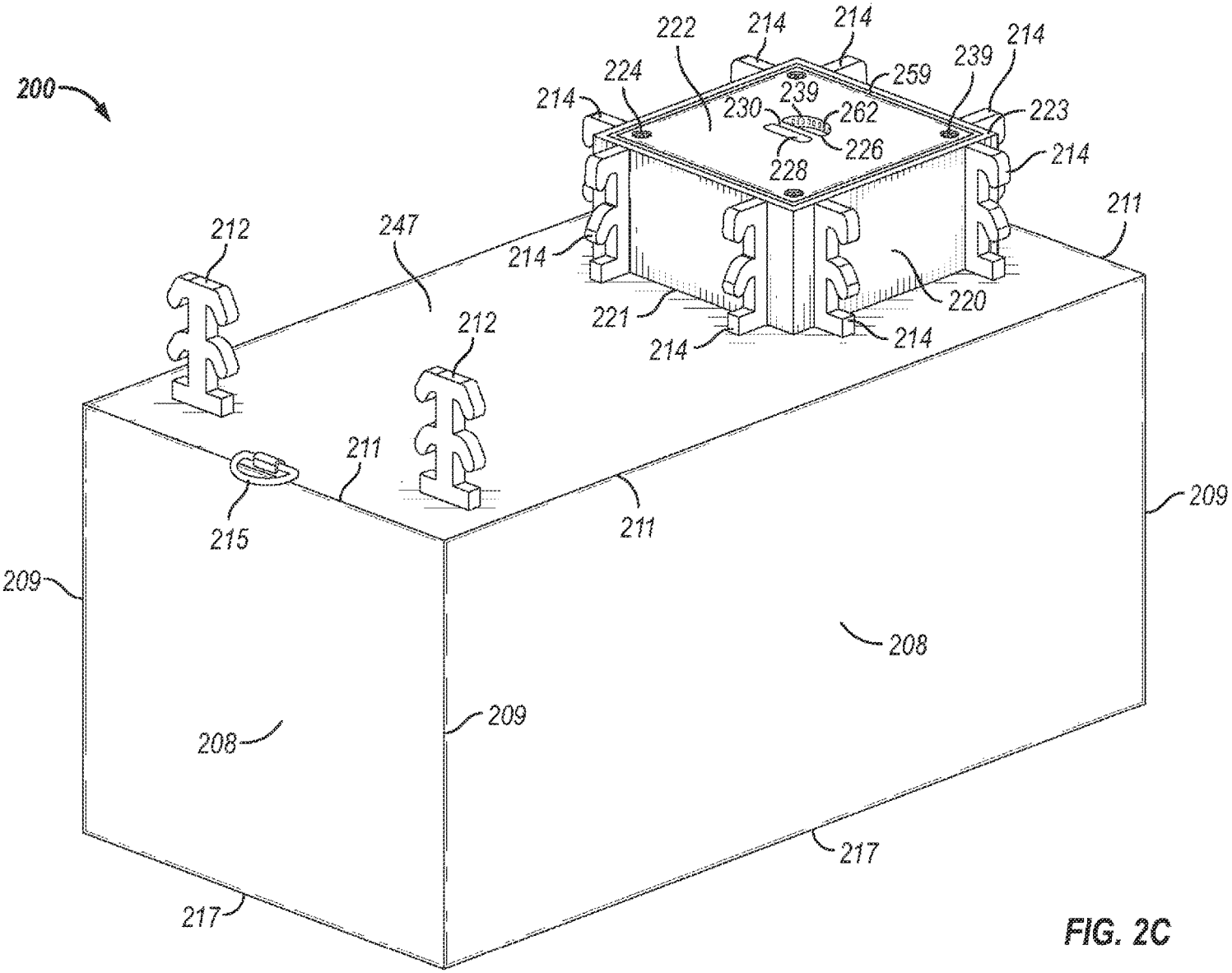

FIG. 2C is a perspective view from the top of an example of the underfloor storage vault.

Figure 2D:
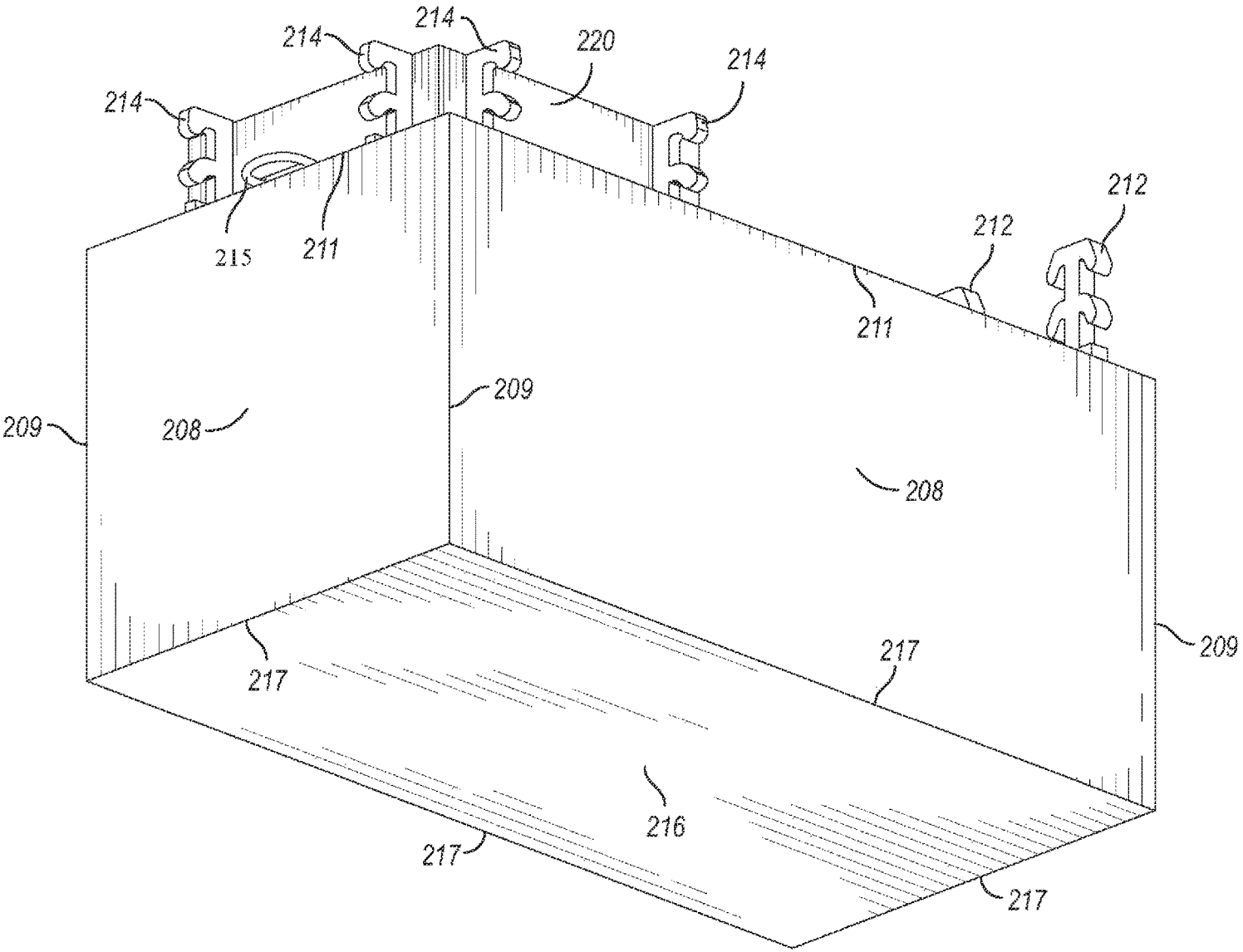

FIG. 2D is a perspective view from the bottom of an example of the underfloor storage vault.

DETAILED DESCRIPTION

One example of the underfloor storage vault may be constructed of a sturdy metal; however, any material or combination of materials sturdy enough to maintain its structure would be sufficient.

FIG. 1A is a front view of an example of the underfloor storage vault 100. One example of the underfloor storage vault 100 may have a front side panel 108 affixed to other side panels (not shown) along vertical side interfaces 109 (only two side interfaces are shown in FIG. 1A). Front side panel 108 may be situated so that its outer surface faces away from a parallel side panel and may be perpendicular to two other side panels that are situated to face away from each other and are parallel to each other. Along base interface 117, front side panel 108 may be affixed to a base panel (not shown) so that the base panel is arranged to be perpendicular with the front side panel 108. One or more of the side panels may also be affixed along a corresponding base interface 117 (only one base interface 117 is shown in FIG. 1A) to the base panel. Together, the side panels, including side panel 108, and base panel may form a container.

At horizontal top interface 111, front side panel 108 may be affixed to a front angled panel 110 which may be angled inwards. The other side panels may also be affixed to a corresponding angled panel (not shown) along a corresponding angled interface (not shown). Front angled panel 110 may be affixed to adjacent angled panels (not shown) along an angle interface 119 (only two angle interfaces 119 are shown in FIG. 1A) and affixed to a hatchway 120 at a hatchway interface 121 which is affixed to the front angled panel 110 on the opposite edge from the horizontal top interface 111. The hatchway 120 may have an entrance aperture (not shown) that allows for access to the interior compartment (not shown) of the underfloor storage vault 100. A hatch (not shown) may be seated in an indenture (not shown) along the top surface of the hatchway 123 that covers the entrance aperture, inhibiting access to the interior compartment underfloor storage vault 100. With the hatch covering the entrance aperture to the hatchway 120, the interior compartment of the underfloor storage vault 100 is almost completely enclosed except for small air inlets (not shown) that may be located in a hatch handle pocket (not shown) located on the hatch.

One or more vertical members 102 may be affixed to the surface of front side panel 108, traversing the surface from the base interface 117 to the horizontal top interface 111. Also, one or more horizontal members 104 may also be affixed to the front side panel 108 that traverse the surface from one vertical side interface 109 to another vertical side interface 109 and intersect vertical members 102. In at least one example, vertical members 102 intersect horizontal members 104 at ninety (90) degree angles. On one end, the horizontal members 104 may be affixed to corresponding horizontal members (not shown) at the opposite end. The corresponding horizontal members traverse the outer surface of other side panels and are affixed end over end so that the entire outer surface may encircled by a horizontal member. One or more base members 118 may traverse the outer surface of the base panel. Multiple base members (not shown) may cross each other at various angles, including ninety (90) degree angles. In one or more examples, one or more of the members (e.g., base members, vertical members, horizontal members, angled members, etc.) may have notches at the point where the members meet to allow for a single weld line to be used on one or more of the members.

The end of the base members 118 may be affixed to ends of vertical members 102 which may be affixed to angle members 106. In the disclosed example of FIG. 1, the base members 118, vertical members 102, horizontal members 104, and angle members 106 are located on the outside surfaces of the underfloor storage vault 100 and affixed to provide structural support. In one or more examples, members may be affixed on the interior compartment surfaces of the underfloor storage vault 100 or arranged in a combination of members affixed on both inside and outside surfaces. The members disclosed in FIG. 1 may be made of metal and may be shaped into a single beam. Other examples include beams with other cross-section shapes such as u-beams, I-beams, or combinations thereof, and may be constructed of any sturdy material capable of providing structural support for the underfloor storage vault 100. Alternate examples also include versions in which different amounts and combinations of vertical members, horizontal members, and/or angle members are affixed to any surface of the underfloor storage 100, including having no members at all affixed to any surface of the underfloor storage vault 100.

One or more brackets 114 (only four (4) brackets 114 are shown in FIG. 1) may be fixed to the outer surface of the underfloor storage vault 100. In one example, the brackets 114 may be attached to the hatchway 120 and a front angled panel 110 and located so that the bracket 114 straddles the hatchway interface 121. Location of the one or more brackets 114 may vary in location and which surfaces they are affixed to. Brackets 114 may be sturdy enough to allow for the underfloor storage vault 100 to be suspended from some sort of mounting support such as rebar. In one or more examples, mounting support that may support the suspension of the underfloor storage vault 100 including, but not limited to, steel beams or wooden beams. Further structural support may be provided by pouring concrete or other type of substance that hardens after being poured around the outside surfaces of the underfloor storage vault 100 to serve as the foundation for a much larger structure to be supported above. Alternatively, dirt may be filled in or structural components may be built up around the underfloor storage vault 100 to provide support.

In one or more examples, an indention (not shown) around the inner lip of the hatchway 120 is present that allows for the hatch (not shown) to be housed over the hatchway aperture so that the top surface (not shown) of the hatch is flush with the top surface of the hatchway 123. When the surrounding structure is constructed after the underfloor storage vault 100 has been placed, flooring may be added that allows for the hatch and top surface of the hatchway 123 may be flush with the surrounding flooring. Carpet may then be placed over the flooring and top surface of the hatchway 123 to further conceal the underfloor storage vault 100.

At least one hatch mounting pocket (not shown) may be located along the surface of the indention that is able to receive a fastener (not shown) to secure the hatch to the hatchway 120. Other examples may not incorporate an indention and allow for the hatch to cover the entire top surface of the hatchway 123. Alternate examples include indentions that allow for hatches that are not flush with the top surface of the hatchway 123.

The example disclosed in FIG. 1 features a box shape formed by front side panel 108, the other side panels, and the base panel which is narrowed at the top end by the front angled panel 110, the other angled panels, and the hatchway 120, all of which is enclosed by the hatch housed in the hatchway 120. Other examples include a different number of side panels, base panels, and angled panels, arranged in a wide variety of configurations. Various possible configurations include other shapes such as, but not limited to, spheres, rectangles, octagons, triangles, irregular shapes, and spherical polyhedrons with tetrahedral, octahedral and icosahedral symmetry.

In one or more examples, the components of the underfloor storage vault 100 are comprised entirely of metal. However, other examples may incorporate other materials that are sturdy enough to maintain structural integrity when the underfloor storage vault 100 is placed under the intended structure. Materials may be mixed and matched to enclose the interior compartment of the underfloor storage vault 100 and maintain structural integrity. The components such as the front side panel 108 may be affixed to other components by various methods including, but not limited to, welding the components together, gluing the components together, using mounting brackets that are fastened to the components through screws, pressure brackets, bolts or some other type of fastener, and various combinations of the foregoing methods.

In one or more examples, one or more hanging trees (not shown) that are essentially the same as the front mounting brackets seen in FIG. 2A-2D may be placed in a variety of locations to facilitate hanging the underfloor storage vault 100 in a wide variety of configurations. The one or more hanging trees may have one or more points to locate the structure (for example, rebar) for hanging the underfloor storage vault 100. The hanging trees may come in a wide variety of configures and sizes, depending on the needs of the user hanging the underfloor storage vault 100.

FIG. 1B is a left-side view of an example of the underfloor storage vault 100 with hatch affixed. A left side panel 131 may have one or more vertical members 102 and one or more horizontal members 104 affixed to the outer surface of the left side panel 108 that crisscross each other and provide structural support. The left side panel 131 may be affixed to other side panels (not shown) along one or more vertical side interfaces 109 (only two vertical side interfaces 109 are shown in FIG. 2). Along a base interface 117, the left side panel 131 may be affixed to a base panel (not shown) that is affixed to other side panels along other base interfaces (not shown). Base members 118 may be affixed along the surface of the base panel and connected to vertical members at one or more ends.

Left side angled panel 133 may be affixed to adjacent angled panels (not shown) along an angle interface 119 (only two angle interfaces 119 are shown in FIG. 1B)

Left angled panel 133 may be affixed to left side panel 131 along a horizontal top interface 111. Other angled panels (not shown) may be affixed to the other side panels which, along with the base panel, form a box shaped container with a narrowed top portion. One or more angled members 106 may be affixed to the left angled panel 133 and affixed to the hatchway 120 to provide further structural support. Ends of the angle members 106 may be affixed to ends of vertical members 102.

A hatchway 120 may be affixed to the left angle panel 133 at the hatchway interface 121. Brackets 114 may be affixed to both the left angled panel 133 and the hatchway 120 which allow for the underfloor storage vault 100 to be suspended and the foundation laid around it. A hatch (not shown) may cover the hatchway aperture (not shown) to inhibit access to an interior compartment (not shown) of the underfloor storage vault 100.

In one or more examples, an indention (not shown) around the inner lip of the hatchway 120 is present that allows for the hatch (not shown) to be housed over the hatchway aperture so that the top surface (not shown) of the hatch is flush with the top surface of the hatchway 123. When the surrounding structure is constructed after the underfloor storage vault 100 has been placed, flooring may be added that allows for the hatch and top surface of the hatchway 123 may be flush with the surrounding flooring. Carpet may then be placed over the flooring and top surface of the hatchway 123 to further conceal the underfloor storage vault 100. In one or more examples, one or more hanging trees (not shown) that are essentially the same as the front mounting brackets seen in FIG. 2A-2D may be placed in a variety of locations (for example, on side panels, angled panels, base panels, attached to members, or attached to the hatchway) to facilitate hanging the underfloor storage vault 100 in a wide variety of configurations. The one or more hanging trees may have one or more points to locate the structure (for example, rebar) for hanging the underfloor storage vault 100. The hanging trees may come in a wide variety of configures and sizes, depending on the needs of the user hanging the underfloor storage vault 100.

FIG. 1C is a right-side view of an example of the underfloor storage vault 100 with hatch affixed. A right side panel 141 may have one or more vertical members 102 and one or more horizontal members 104 affixed to the outer surface of the right side panel 141 that crisscross each other and provide structural support. The right side panel 141 may be affixed to other side panels (not shown) along one or more vertical side interfaces 109 (only two vertical side interfaces 109 are shown in FIG. 3). Along a base interface 117, the right side panel 141 may be affixed to a base panel (not shown) that is affixed to other side panels along other base interfaces (not shown). Base members 118 may be affixed along the surface of the base panel and connected to vertical members at one or more ends.

Right angled panel 143 may be affixed to adjacent angled panels (not shown) along an angle interface 119 (only two angle interfaces 119 are shown in FIG. 1C). In one or more examples, one or more hanging trees (not shown) that are essentially the same as the front mounting brackets seen in FIG. 2A-2D may be placed in a variety of locations (for example, on side panels, angled panels, base panels, attached to members, or attached to the hatchway) to facilitate hanging the underfloor storage vault 100 in a wide variety of configurations. The one or more hanging trees may have one or more points to locate the structure (for example, rebar) for hanging the underfloor storage vault 100. The hanging trees may come in a wide variety of configures and sizes, depending on the needs of the user hanging the underfloor storage vault 100.

Right angled panel 143 may be affixed to right side panel 141 along a horizontal top interface 111. Other angled panels (not shown) may be affixed to the other side panels which, along with the base panel, form a box shaped container with a narrowed top portion. One or more angled members 106 may be affixed to the right angled panel 143 and affixed to the hatchway 120 to provide further structural support. Ends of the angle members 106 may be affixed to ends of vertical members 102.

A hatchway 120 may be affixed to the right angle panel 143 at the hatchway interface 121. Brackets 114 may be affixed to both the right angled panel 143 and the hatchway 120 which allow for the underfloor storage vault 100 to be suspended and the foundation laid around it. A hatch (not shown) may be housed in the hatchway 120 and cover the hatchway aperture (not shown) to inhibit access to an interior compartment (not shown) of the underfloor storage vault 100.

In one or more examples, an indention (not shown) around the inner lip of the hatchway 120 is present that allows for the hatch (not shown) to be housed over the hatchway aperture so that the top surface (not shown) of the hatch is flush with the top surface of the hatchway 123. When the surrounding structure is constructed after the underfloor storage vault 100 has been placed, flooring may be added that allows for the hatch and top surface of the hatchway 123 may be flush with the surrounding flooring. Carpet may then be placed over the flooring and top surface of the hatchway 123 to further conceal the underfloor storage vault 100. In one or more examples, one or more hanging trees (not shown) that are essentially the same as the front mounting brackets seen in FIG. 2A-2D may be placed in a variety of locations (for example, on side panels, angled panels, base panels, attached to members, or attached to the hatchway) to facilitate hanging the underfloor storage vault 100 in a wide variety of configurations. The one or more hanging trees may have one or more points to locate the structure (for example, rebar) for hanging the underfloor storage vault 100. The hanging trees may come in a wide variety of configures and sizes, depending on the needs of the user hanging the underfloor storage vault 100.

FIG. 1D is a rear view of an example of the underfloor storage vault with hatch affixed. A rear side panel 151 may have one or more vertical members 102 and one or more horizontal members 104 affixed to the outer surface of the rear side panel 151 that crisscross each other and provide structural support. The rear side panel 151 may be affixed to other side panels (not shown) along one or more vertical side interfaces 109 (only two vertical side interfaces 109 are shown in FIG. 4). Along a base interface 117, the rear side panel 151 may be affixed to a base panel (not shown) that is affixed to other side panels along other base interfaces (not shown). Base members 118 may be affixed along the surface of the base panel and connected to vertical members at one or more ends.

Rear angled panel 153 may be affixed to adjacent angled panels (not shown) along an angle interface 119 (only two angle interfaces 119 are shown in FIG. 1D). In one or more examples, one or more hanging trees (not shown) that are essentially the same as the front mounting brackets seen in FIG. 2A-2D may be placed in a variety of locations (for example, on side panels, angled panels, base panels, attached to members, or attached to the hatchway) to facilitate hanging the underfloor storage vault 100 in a wide variety of configurations. The one or more hanging trees may have one or more points to locate the structure (for example, rebar) for hanging the underfloor storage vault 100. The hanging trees may come in a wide variety of configures and sizes, depending on the needs of the user hanging the underfloor storage vault 100.

Rear angled panel 153 may be affixed to rear side panel 151 along a horizontal top interface 111. Other angled panels (not shown) may be affixed to the other side panels which, along with the base panel, form a box shaped container with a narrowed top portion. One or more angled members 106 may be affixed to the rear angled panel 153 and affixed to the hatchway 120 to provide further structural support. Ends of the angle members 106 may be affixed to ends of vertical members 102.

A hatchway 120 may be affixed to the rear angle panel 153 at the hatchway interface 121. Brackets 114 may be affixed to both the rear angled panel 153 and the hatchway 120 which allow for the underfloor storage vault 100 to be suspended and the foundation laid around it. A hatch (not shown) may be housed in the hatchway 120 and cover the hatchway aperture (not shown) to inhibit access to an interior compartment (not shown) of the underfloor storage vault 100.

In one or more examples, an indention (not shown) around the inner lip of the hatchway 120 is present that allows for the hatch (not shown) to be housed over the hatchway aperture so that the top surface (not shown) of the hatch is flush with the top surface of the hatchway 123. When the surrounding structure is constructed after the underfloor storage vault 100 has been placed, flooring may be added that allows for the hatch and top surface of the hatchway 123 may be flush with the surrounding flooring. Carpet may then be placed over the flooring and top surface of the hatchway 123 to further conceal the underfloor storage vault 100.

FIG. 1E is an underneath view of an example of the underfloor storage vault 100. The base panel 116 may be affixed to side panels (not shown) along its edges at base interfaces 117 such that the base panel 116 is perpendicular with the side panels. One or more base members 118 may traverse the outer surface of the base panel 116 and crisscross with other base members 118. At one or more ends of the base members 118, the base members may be affixed to ends of vertical members (not shown) that traverse side panels and crisscross horizontal members 104 that also traverse the outer surface of the side panels. In one or more examples, one or more hanging trees (not shown) that are essentially the same as the front mounting brackets seen in FIG. 2A-2D may be placed in a variety of locations to facilitate hanging the underfloor storage vault 100 in a wide variety of configurations. The one or more hanging trees may have one or more points to locate the structure (for example, rebar) for hanging the underfloor storage vault 100. The hanging trees may come in a wide variety of configures and sizes, depending on the needs of the user hanging the underfloor storage vault 100.

FIG. 1F is a top view of an example of the underfloor storage vault 100 with hatch affixed. The front angle panel 110 may be affixed to the left angle panel 133 and right angle panel 143 along angle interfaces 119. On the opposite ends of left panel 133 and right panel 143, rear angle panel 153 may be affixed to the left angle panel 133 and right angle panel 143 along two other corresponding angle interfaces 119. Angle members 106 may traverse the outer surfaces of front angle panel 110, left angle panel 133, right angle panel 143, and rear angle panel 153. One end of each angle member may be affixed to the hatch way 120 and the other end may be affixed to the ends of vertical members (not shown) that traverse the surface of side panels (not shown). The vertical members may crisscross horizontal members 104 that also traverse the surface of the side panels. Brackets 114 may be affixed to the hatchway 120 and the front angle panel 110, left angle panel 133, right angle panel 143, and rear angle panel 153. The brackets 114 may allow for the underfloor storage vault 100 to be suspended while foundation pour around it to provide further support.

One or more hatch holes 156 may be located around the outer surface of the hatch 122. Mounting fasteners 124 may traverse through the hatch mount holes 156 and be inserted into hatchway pockets (not shown) that allow for the hatch to be secured to the hatchway 120. In one example, the hatch holes 156 are recessed so that the mounting fasteners 124 do not protrude above the outer surface of the hatch 122. The recess is intended to make it harder for thieves to cut portions of the mounting fasteners 124 with bolt cutters to gain access to the underfloor storage vault 100. The hatch 122 may be housed in a hatchway indention 159 around the outer rim of the hatchway 120 to allow for the outer surface of the hatch 122 to be flush with the top surface of the hatchway 123.

A first handle aperture 126 and a second handle aperture 128 may be located near the center of the hatch 122 and arranged so that a handle 130 may allow for an individual to grab hold of the hatch 122 and pull it open with ease if the mounting fasteners 124 have been removed.

Angled panels 110, 133, 143, 153 may be affixed to side panels along a horizontal top interface 111. In one or more examples, one or more hanging trees (not shown) that are essentially the same as the front mounting brackets seen in FIG. 2A-2D may be placed in a variety of locations to facilitate hanging the underfloor storage vault 100 in a wide variety of configurations. The one or more hanging trees may have one or more points to locate the structure (for example, rebar) for hanging the underfloor storage vault 100. The hanging trees may come in a wide variety of configures and sizes, depending on the needs of the user hanging the underfloor storage vault 100.

FIG. 1G is a top view of an example of the underfloor storage vault 100 without hatch affixed. The front angle panel 110 may be affixed to the left angle panel 133 and right angle panel 143 along angle interfaces 119. On the opposite ends of left panel 133 and right panel 143, rear angle panel 153 may be affixed to the left angle panel 133 and right angle panel 143 along two other corresponding angle interfaces 119. Angle members 106 may traverse the outer surfaces of front angle panel 110, left angle panel 133, right angle panel 143, and rear angle panel 153. One end of each angle member may be affixed to the hatch way 120 and the other end may be affixed to the ends of vertical members (not shown) that traverse the surface of side panels (not shown). The vertical members may crisscross horizontal members 104 that also traverse the surface of the side panels. Brackets 114 may be affixed to the hatchway 120 and the front angle panel 110, left angle panel 133, right angle panel 143, and rear angle panel 153. The brackets 114 may allow for the underfloor storage vault 100 to be suspended while foundation pour around it to provide further support.

Mounting fasteners 124 that have traversed through hatch holes 156 may be housed in hatchway pockets that may be located along the hatchway indention 159, thereby securing the hatch (not shown) to the hatchway 120. The hatchway indention 159 may allow for the hatch 122 to be housed in the hatchway 120 so that the top surface of the hatch 120 is flush with the top surface of the hatchway 123. In the interior of the underfloor storage vault 100 A ladder 140 may descend from the hatchway 122 to the base panel 116, allowing an individual to descend on one or more ladder rungs 142 into the compartment of the underfloor storage vault 100. In one example, the ladder 140 and ladder rungs 142 are constructed of metal. Other examples envision other materials such as fibrous threading or rope. Possessions and valuables of all kinds may be stored inside the compartment of underfloor storage vault 100. An individual may remove the hatch from the hatchway 122 and descend down the ladder 140 with relative ease to house items for safe keeping.

Angled panels 110, 133, 143, 153 may be affixed to side panels along a horizontal top interface 111. In one or more examples, one or more hanging trees (not shown) that are essentially the same as the front mounting brackets seen in FIG. 2A-2D may be placed in a variety of locations (for example, on side panels, angled panels, base panels, attached to members, or attached to the hatchway) to facilitate hanging the underfloor storage vault 100 in a wide variety of configurations. The one or more hanging trees may have one or more points to locate the structure (for example, rebar) for hanging the underfloor storage vault 100. The hanging trees may come in a wide variety of configures and sizes, depending on the needs of the user hanging the underfloor storage vault 100.

FIG. 1H is a cross-section front view of an example of the underfloor storage vault 100. Base members 118 may traverse the surface of the base panel 116 and be affixed to vertical members 102 that traverse the surface of side panels 131, 141, 151. Horizontal members may also traverse the surface of side panes 131, 141, 151 and crisscross the vertical members 102.

Vertical members 102 may also be affixed to angled members 102 on opposite ends that traverse the surface of angled panels 133, 143, 153. The hatchway 120 may be affixed to the ends of angled members 106 as well. A hatchway indentation 159 may allow for a hatch (not shown) to be housed such that the outer surface of the hatch is flush with the top surface of the hatchway 123. Brackets may be affixed to the hatchway 120 and the angled panels 133, 143, 153 that allow for the underfloor storage vault 100 to be suspended before a foundation is filled in around it. The ladder 140 with one or more ladder rungs 142 may descend into the interior of the underfloor storage vault 100 to the base panel 116. In one or more examples, one or more hanging trees (not shown) that are essentially the same as the front mounting brackets seen in FIG. 2A-2D may be placed in a variety of locations (for example, on side panels, angled panels, base panels, attached to members, or attached to the hatchway) to facilitate hanging the underfloor storage vault 100 in a wide variety of configurations. The one or more hanging trees may have one or more points to locate the structure (for example, rebar) for hanging the underfloor storage vault 100. The hanging trees may come in a wide variety of configures and sizes, depending on the needs of the user hanging the underfloor storage vault 100.

FIG. 1I is a cross-section side view of an example of the underfloor storage vault 100. Base members 118 may traverse the surface of the base panel 116 and be affixed to vertical members 102 that traverse the surface of side panels 108, 151. Horizontal members may also traverse the surface of side panes 108, 151 and crisscross the vertical members 102.

Vertical members 102 may also be affixed to angled members 102 on opposite ends that traverse the surface of angled panels 110, 153. The hatchway 120 may be affixed to the ends of angled members 106 as well. A hatchway indentation 159 may allow for a hatch (not shown) to be housed such that the outer surface of the hatch is flush with the top surface of the hatchway 123. Brackets may be affixed to the hatchway 120 and the angled panels 110, 153 that allow for the underfloor storage vault 100 to be suspended before a foundation is filled in around it. The ladder 140 with one or more ladder rungs 142 may descend into the interior of the underfloor storage vault 100 to the base panel 116.

Right side panel 141 may be affixed to right angle panel 143. along a top horizontal interface 111. In one or more examples, one or more hanging trees (not shown) that are essentially the same as the front mounting brackets seen in FIG. 2A-2D may be placed in a variety of locations (for example, on side panels, angled panels, base panels, attached to members, or attached to the hatchway) to facilitate hanging the underfloor storage vault 100 in a wide variety of configurations. The one or more hanging trees may have one or more points to locate the structure (for example, rebar) for hanging the underfloor storage vault 100. The hanging trees may come in a wide variety of configures and sizes, depending on the needs of the user hanging the underfloor storage vault 100.

FIG. 1J is a perspective view from the top of an example of the underfloor storage vault 100. Front side panel 108, left side panel 131, other side panels (not shown), base panel (not shown), front angled panel 110, left angled panel 133, other angled panels (not shown), and the hatchway 120 enclose an interior compartment of the underfloor storage vault 100. Horizontal members 104 traverse the outer surfaces of front side panel 108 and left side panel 131 and crisscross with vertical members 102. On one end, vertical members 102 may be affixed to base members and be affixed to angled members on the other end.

Brackets 114 for mounting the underfloor storage vault 100 may be affixed to the hatchway 120 and angled panels 110, 133. The hatchway aperture 138 may allow for access to the interior of the underfloor storage vault 100. Ladder 140 with ladder rungs 142 may descend into the underfloor storage vault 100. The hatchway indention 159 may allow for the hatch (not shown) to be housed in the hatchway 120 such that the top surface of the hatch is flush with the top surface of the Hatchway 123.

A rear side panel 151 may have one or more vertical members 102 and one or more horizontal members 104 affixed to the outer surface of the rear side panel 151 that crisscross each other and provide structural support. The rear side panel 151 may be affixed to other side panels (not shown) along one or more vertical side interfaces 109 (only two vertical side interfaces 109 are shown in FIG. 4). Along a base interface 117, the rear side panel 151 may be affixed to a base panel (not shown) that is affixed to other side panels along other base interfaces (not shown). Base members 118 may be affixed along the surface of the base panel and connected to vertical members at one or more ends.

Rear angled panel 153 may be affixed to adjacent angled panels (not shown) along an angle interface 119 (only two angle interfaces 119 are shown in FIG. 1D)

Rear angled panel 153 may be affixed to rear side panel 151 along a horizontal top interface 111. Other angled panels (not shown) may be affixed to the other side panels which, along with the base panel, form a box shaped container with a narrowed top portion. One or more angled members 106 may be affixed to the rear angled panel 153 and affixed to the hatchway 120 to provide further structural support. Ends of the angle members 106 may be affixed to ends of vertical members 102.

A hatchway 120 may be affixed to the rear angle panel 153 at the hatchway interface 121. Brackets 114 may be affixed to both the rear angled panel 153 and the hatchway 120 which allow for the underfloor storage vault 100 to be suspended and the foundation laid around it. A hatch (not shown) may be housed in the hatchway 120 and cover the hatchway aperture (not shown) to inhibit access to an interior compartment (not shown) of the underfloor storage vault 100.

In one or more examples, an indention (not shown) around the inner lip of the hatchway 120 is present that allows for the hatch (not shown) to be housed over the hatchway aperture so that the top surface (not shown) of the hatch is flush with the top surface of the hatchway 123. When the surrounding structure is constructed after the underfloor storage vault 100 has been placed, flooring may be added that allows for the hatch and top surface of the hatchway 123 may be flush with the surrounding flooring. Carpet may then be placed over the flooring and top surface of the hatchway 123 to further conceal the underfloor storage vault 100.

FIG. 1K is a perspective view from the top of top of an example of the underfloor storage vault with hatch affixed. Front side panel 108, left side panel 131, other side panels (not shown), base panel (not shown), front angled panel 110, left angled panel 133, other angled panels (not shown), and the hatchway 120 enclose an interior compartment of the underfloor storage vault 100. Horizontal members 104 traverse the outer surfaces of front side panel 108 and left side panel 131 and crisscross with vertical members 102. On one end, vertical members 102 may be affixed to base members and be affixed to angled members on the other end.

Brackets 114 for mounting the underfloor storage vault 100 may be affixed to the hatchway 120 and angled panels 110, 133. The hatchway aperture (not shown) may allow for access to the interior of the underfloor storage vault 100. Ladder (not shown) with ladder rungs (not shown) may descend into the underfloor storage vault 100. The hatchway indention 159 may allow for the hatch 120 to be housed in the hatchway 120 such that the top surface of the hatch 120 is flush with the top surface of the Hatchway 123. The handle 130 may be located in between the first handle aperture 126 and the second handle aperture 128 along the top surface of the hatch 120, allowing an individual to grasp and pull the hatch 120 away from the hatchway 120. In one example, hinges (not shown) may be affixed to the hatch 120 and hatchway 120 to direct the opening and closing of the hatch 120.

A rear side panel 151 may have one or more vertical members 102 and one or more horizontal members 104 affixed to the outer surface of the rear side panel 151 that crisscross each other and provide structural support. The rear side panel 151 may be affixed to other side panels (not shown) along one or more vertical side interfaces 109 (only two vertical side interfaces 109 are shown in FIG. 4). Along a base interface 117, the rear side panel 151 may be affixed to a base panel (not shown) that is affixed to other side panels along other base interfaces (not shown). Base members 118 may be affixed along the surface of the base panel and connected to vertical members at one or more ends.

Rear angled panel 153 may be affixed to adjacent angled panels (not shown) along an angle interface 119 (only two angle interfaces 119 are shown in FIG. 1D)

Rear angled panel 153 may be affixed to rear side panel 151 along a horizontal top interface 111. Other angled panels (not shown) may be affixed to the other side panels which, along with the base panel, form a box shaped container with a narrowed top portion. One or more angled members 106 may be affixed to the rear angled panel 153 and affixed to the hatchway 120 to provide further structural support. Ends of the angle members 106 may be affixed to ends of vertical members 102.

A hatchway 120 may be affixed to the rear angle panel 153 at the hatchway interface 121. Brackets 114 may be affixed to both the rear angled panel 153 and the hatchway 120 which allow for the underfloor storage vault 100 to be suspended and the foundation laid around it. A hatch (not shown) may be housed in the hatchway 120 and cover the hatchway aperture (not shown) to inhibit access to an interior compartment (not shown) of the underfloor storage vault 100.

In one or more examples, an indention (not shown) around the inner lip of the hatchway 120 is present that allows for the hatch (not shown) to be housed over the hatchway aperture so that the top surface (not shown) of the hatch is flush with the top surface of the hatchway 123. When the surrounding structure is constructed after the underfloor storage vault 100 has been placed, flooring may be added that allows for the hatch and top surface of the hatchway 123 may be flush with the surrounding flooring. Carpet may then be placed over the flooring and top surface of the hatchway 123 to further conceal the underfloor storage vault 100.

On the top surface of the hatch 122, a handle 130 may be situated between a first aperture 126 and a second aperture 128. Both first aperture 126 and second aperture 128 may allow for access to a hatch pocket 139. An individual may reach into the hatch pocket and grasp the handle 130. By pulling away from the hatchway (not shown) that the hatch 122 is seated in, the hatch may be removed so that the individual may access the interior compartment of the underfloor storage vault. By locating the handle in between the first aperture 126 and second aperture 128, the handle 130 may not protrude on the hatch, allowing for the hatch to be easily operated, while keeping entire top surface of the hatch 122 flush with the top surface of the hatchway. Other examples feature other types of handles that may protrude from the top surface of the hatch 122 such as "t" bar handles affixed to the top surface of the hatch 122 or various types of knobs.

In one example, on or more small air inlets 162 are positioned along a portion of the surface of the hatch pocket 139 to allow for air to move freely in and out of the interior compartment of the underfloor storage vault. Other examples do not include air inlets along a surface of the hatch pocket 139.

The top surface of the hatch 122 may have one or more hatch holes 156 which allow for a mounting fastener 124 to traverse through the hatch 122 and protrude out the other side. The entrance of the hatch holes 159 may be sunken into the top surface of the hatch 122 so that the top of the mounting fastener 124 may be shielded from individuals using cutters (e.g., bolt cutters) to cut the top of the mounting fasteners 124 and gain unauthorized access to the interior of the underfloor storage vault.

The protruding end of the mounting fastener 124 may enter into a corresponding hatchway pocket (not shown) located on a hatchway (not shown). By housing the hatch 122 in an indention (not shown) along the rim of the hatch so that the top surface of the hatch 122 is flush with the top surface of the hatchway (not shown), the mounting fasteners 124 may secure the hatch 122 to the hatchway so that the hatchway aperture (not shown) is completely covered.

In one example, the mounting fasteners 124 may have a specialized receiving pocket that only allows for a special insertion tool (not shown) with a matching insertion end to be inserted into the receiving pocket of the mounting fastener 124. Only the insertion tool with the matching insertion end may be properly seated in the receiving pocket. Once inserted, the insertion tool may engage with the corresponding mounting fastener 124 to turn it which allows for the mounting fastener tool to be disengaged with the hatch hole 156 and the hatchway pocket underneath. Only an individual with the proper insertion tool that corresponds with the receiving pocket on the mounting fastener may be able to properly remove the fasteners and gain access to the internal compartment of the underfloor storage vault. Any attempt to engage the receiving pocket and seat a tool without a matching insertion end will not turn the mounting fastener. Once all mounting fasteners 124 have been disengaged from the hatch, the hatch may be unseated and removed from the indention on the hatchway, thereby allowing access to the interior compartment of the underfloor storage vault. Other examples include other types of mounting fasteners 124 that may not have a specialized receiving pocket, allowing for normal screwdrivers or other tools to properly engage with the mounting fasteners 124. In one or more examples, "U" bars, hooks or loops may be affixed to the hatch 122 and hatchway which allow for other types locking mechanisms to be utilized such as combination locks, key locks and/or chains.

FIG. 1L is a close-up perspective from the top of the hatch 122 for the underfloor storage vault. On the top surface of the hatch 122, a handle 130 may be situated between a first aperture 126 and a second aperture 128. Both first aperture 126 and second aperture 128 may allow for access to a hatch pocket 139. An individual may reach into the hatch pocket and grasp the handle 130. By pulling away from the hatchway (not shown) that the hatch 122 is seated in, the hatch may be removed so that the individual may access the interior compartment of the underfloor storage vault. By locating the handle in between the first aperture 126 and second aperture 128, the handle 130 may not protrude on the hatch, allowing for the hatch to be easily operated, while keeping entire top surface of the hatch 122 flush with the top surface of the hatchway. Other examples feature other types of handles that may protrude from the top surface of the hatch 122 such as "t" bar handles affixed to the top surface of the hatch 122 or various types of knobs.

In one example, on or more small air inlets 162 are positioned along a portion of the surface of the hatch pocket 139 to allow for air to move freely in and out of the interior compartment of the underfloor storage vault. Other examples do not include air inlets along a surface of the hatch pocket 139.

The top surface of the hatch 122 may have one or more hatch holes 156 which allow for a mounting fastener 124 to traverse through the hatch 122 and protrude out the other side. The entrance of the hatch holes 159 may be sunken into the top surface of the hatch 122 so that the top of the mounting fastener 124 may be shielded from individuals using cutters (e.g., bolt cutters) to cut the top of the mounting fasteners 124 and gain unauthorized access to the interior of the underfloor storage vault.

The protruding end of the mounting fastener 124 may enter into a corresponding hatchway pocket (not shown) located on a hatchway (not shown). By housing the hatch 122 in an indention (not shown) along the rim of the hatch so that the top surface of the hatch 122 is flush with the top surface of the hatchway (not shown), the mounting fasteners 124 may secure the hatch 122 to the hatchway so that the hatchway aperture (not shown) is completely covered.

In one example, the mounting fasteners 124 may have a specialized receiving pocket that only allows for a special insertion tool (not shown) with a matching insertion end to be inserted into the receiving pocket of the mounting fastener 124. Only the insertion tool with the matching insertion end may be properly seated in the receiving pocket. Once inserted, the insertion tool may engage with the corresponding mounting fastener 124 to turn it which allows for the mounting fastener tool to be disengaged with the hatch hole 156 and the hatchway pocket underneath. Only an individual with the proper insertion tool that corresponds with the receiving pocket on the mounting fastener may be able to properly remove the fasteners and gain access to the internal compartment of the underfloor storage vault. Any attempt to engage the receiving pocket and seat a tool without a matching insertion end will not turn the mounting fastener. Once all mounting fasteners 124 have been disengaged from the hatch, the hatch may be unseated and removed from the indention on the hatchway, thereby allowing access to the interior compartment of the underfloor storage vault. Other examples include other types of mounting fasteners 124 that may not have a specialized receiving pocket, allowing for normal screwdrivers or other tools to properly engage with the mounting fasteners 124. In one or more examples, "U" bars, hooks or loops may be affixed to the hatch 122 and hatchway which allow for other types locking mechanisms to be utilized such as combination locks, key locks and/or chains.

FIG. 1M is a close-up perspective from the bottom of the hatch for the underfloor storage vault. On the top surface of the hatch 124, a handle 130 may be situated between a first aperture 126 and a second aperture 128. Both first aperture 126 and second aperture 128 may allow for access to a hatch pocket 139. An individual may reach into the hatch pocket and grasp the handle 130. By pulling away from the hatchway (not shown) that the hatch 122 is seated in, the hatch may be removed so that the individual may access the interior compartment of the underfloor storage vault. By locating the handle in between the first aperture 126 and second aperture 128, the handle does not protrude on the hatch, allowing for the hatch to be easily operated, while keeping entire top surface of the hatch 122 flush with the top surface of the hatchway.

One or more air inlets 162 are positioned along a portion of the surface of the underside surface hatch pocket 139 to allow for air to move freely in and out of the interior compartment of the underfloor storage vault. Other examples do not include air inlets along a surface of the hatch pocket 139. The top surface of the hatch 122 may have one or more hatch holes 156 which allow for a mounting fastener 124 to traverse through the hatch 122 and protrude out the other side. The entrance of the hatch holes 156 may be sunken into the top surface of the hatch 122 so that the top of the mounting fastener 124 may be shield from individuals using cutters to cut the top of the mounting fasteners 124 and gain unauthorized access to the interior of the underfloor storage vault.

The protruding end of the mounting fastener 124 may enter into a corresponding hatchway pocket (not shown) located on a hatchway (not shown). By housing the hatch 122 in an indention (not shown) along the rim of the hatch so that the top surface of the hatch 122 is flush with the top surface of the hatchway (not shown), the mounting fasteners 124 may secure the hatch 122 to the hatchway so that the hatchway aperture (not shown) is completely covered. the mounting fasteners 124 may have a specialized receiving pocket that only allows for a special insertion tool (not shown) with a matching insertion end to be inserted into the receiving pocket of the mounting fastener 124. Only the insertion tool with the matching insertion end may be properly seated in the receiving pocket. Once inserted, the insertion tool may engage with the corresponding mounting fastener 124 to turn it which allows for the mounting fastener tool to be disengaged with the hatch hole 156 and the hatchway pocket underneath. Only an individual with the proper insertion tool that corresponds with the receiving pocket on the mounting fastener may be able to properly remove the fasteners and gain access to the internal compartment of the underfloor storage vault. Any attempt to engage the receiving pocket and seat a tool without a matching insertion end will not turn the mounting fastener. Once all mounting fasteners 124 have been disengaged from the hatch, the hatch may be unseated and removed from the indention on the hatchway, thereby allowing access to the interior compartment of the underfloor storage vault.

FIG. 1N a side cross-section view of the hatch for the underfloor storage vault. On the top surface of the hatch 124, a handle 130 may be situated between a first aperture 126 and a second aperture 128. Both first aperture 126 and second aperture 128 may allow for access to a hatch pocket 139. An individual may reach into the hatch pocket and grasp the handle 130. By pulling away from the hatchway (not shown) that the hatch 122 is seated in, the hatch may be removed so that the individual may access the interior compartment of the underfloor storage vault. By locating the handle in between the first aperture 126 and second aperture 128, the handle does not protrude on the hatch, allowing for the hatch to be easily operated, while keeping entire top surface of the hatch 122 flush with the top surface of the hatchway.

One or more air inlets 162 are positioned along a portion of the surface of the underside surface hatch pocket 139 to allow for air to move freely in and out of the interior compartment of the underfloor storage vault. Other examples do not include air inlets along a surface of the hatch pocket 139. The top surface of the hatch 122 may have one or more hatch holes 156 which allow for a mounting fastener 124 to traverse through the hatch 122 and protrude out the other side. The entrance of the hatch holes 156 may be sunken into the top surface of the hatch 122 so that the top of the mounting fastener 124 may be shield from individuals using cutters to cut the top of the mounting fasteners 124 and gain unauthorized access to the interior of the underfloor storage vault.

The protruding end of the mounting fastener 124 may enter into a corresponding hatchway pocket (not shown) located on a hatchway (not shown). By housing the hatch 122 in an indention (not shown) along the rim of the hatch so that the top surface of the hatch 122 is flush with the top surface of the hatchway (not shown), the mounting fasteners 124 may secure the hatch 122 to the hatchway so that the hatchway aperture (not shown) is completely covered. the mounting fasteners 124 may have a specialized receiving pocket that only allows for a special insertion tool (not shown) with a matching insertion end to be inserted into the receiving pocket of the mounting fastener 124. Only the insertion tool with the matching insertion end may be properly seated in the receiving pocket. Once inserted, the insertion tool may engage with the corresponding mounting fastener 124 to turn it which allows for the mounting fastener tool to be disengaged with the hatch hole 156 and the hatchway pocket underneath. Only an individual with the proper insertion tool that corresponds with the receiving pocket on the mounting fastener may be able to properly remove the fasteners and gain access to the internal compartment of the underfloor storage vault. Any attempt to engage the receiving pocket and seat a tool without a matching insertion end will not turn the mounting fastener. Once all mounting fasteners 124 have been disengaged from the hatch, the hatch may be unseated and removed from the indention on the hatchway, thereby allowing access to the interior compartment of the underfloor storage vault.

FIG. 1O is a close-up perspective from the top of the hatch 122 properly seated in the indention of the hatchway. The hatch 122 may be housed in the indention 159 such that the top surface of the hatch 122 is flush with the top surface of the hatchway 123. Hatch holes 156 allow mounting fasteners 124 to traverse through the hatch 122. Protruding out the underside of the hatch 122, the mounting fasteners 124 may engage with a hatchway pocket that allows for the hatch 122 to be secured to the hatchway 120. The hatch holes 156 may be sunken into the top surface of the hatch 122 to allow for the mounting fasteners 124 to be inserted without any portion of the mounting fasteners 124 protruding above the top surface of the hatch 122. Having the mounting fasteners seat below the top surface of the hatch allows for the entire hatch 122 surface to be flush with the top surface of the hatchway 123.

FIG. 1P is a close-up perspective from the top of the in the indention 159 of the hatchway. The hatchway 120 may have an indention 159 that allows for a hatch (not shown) to be seated such that the top surface of the hatch is flush with the top surface of the hatchway 123. The hatch may have a shape that is slightly smaller than the potion of the hatchway 120, allowing for the hatch to fit snuggly in the hatchway 120. One or more hatchway pockets 139 may be located along the indention 159 that are able to receive and engage with mounting fasteners (not shown) that protrude out the underside of the hatch. When the hatchway pockets 139 have received and engaged with the mounting fasteners, the hatch may be seated correctly in the indention 159. Once seated, the hatch covers the hatchway aperture 138, inhibiting access to the interior of the underfloor storage vault (not shown).

FIG. 2A is a front view of an example of the underfloor storage vault 200. The underfloor storage vault 200 may have four side panels (only one side panel 208 is shown in FIG. 2A) and one base panel (not shown). Each side panel 208 may be affixed to another side panel along a side interface 209. The base panel 208 may be affixed to one or more of the side panels 208 along a base interface 217. A top panel (not shown) may be affixed to one or more of the side panels 208 along a top interface 211. On top of the top panel, a hatchway 220 may be affixed that has a top surface 223. Front mounting brackets 212 may be positioned on and affixed to the top panel. Hatchway brackets 214 may be affixed to the hatchway.

In FIG. 2A, the hatchway brackets 214 are positioned so that at least one of the hatchway brackets 214 align so that a mounting bar (not shown) may be suspended between at least one hatchway bracket 214 and a front mounting bracket 212, allowing for the underfloor storage vault 200 to be suspended. After the underfloor storage vault 200 has been suspended, it may be secured in place by a variety of means including, but not limited to, pouring concrete around it, packing in small particles or debris around it, affixing other braces or joists to it, etc.

One or more suspension brackets 215 or hook may be affixed to the underfloor storage vault 200 to allow for a cable or other tethered means of being connected to it. With one or more tethered means connected to the underfloor storage vault, the underfloor storage vault may be able to be lifted and moved easily. In one or more examples, one or more chains may be connected to the suspension brackets 215. The one or more chains may be strong enough to support the weight of the underfloor storage vault 200, allowing for easy movement and placement of the underfloor storage vault 200.

FIG. 2B is a left-side view of an example of the underfloor storage vault 200. A side panel 208 may be affixed to other side panels along a side interface 209. Along a base interface 217, the side panel 208 may be affixed to a base panel (not shown). A top panel (not shown) may be affixed to the side panel 208 along a top interface 211. One or more suspension brackets 215 may be affixed to the underfloor storage vault 200. In FIG. 2B, the one or more suspension brackets 215 are located on near the edges of the top panel. Placement of the one or more suspension brackets 215 may vary. Other examples may include the one or more suspension brackets 215 located on the side panel 208, the base panel, the hatchway 220, or any combination of the aforementioned locations. In one or more examples, there are more than one hatchways 220 that allow for access to the interior of the underfloor storage vault 200. The example in FIG. 2B features an interior that has a single compartment. The interior of the underfloor storage vault 200 may be compartmentalized into more than one compartment and additional hatchways 220 may allow access to different compartments.

A hatchway 220 may be affixed to the underfloor storage vault 200. In the example in FIG. 2B, the hatchway 220 is affixed on the top panel and near one of its edges. Other examples allow for the hatchway 220 to be affixed on a side panel, or a base panel. Placement can also vary with the hatchway 220 being placed at or near the center or anywhere on the underfloor storage vault 200 in which the hatchway 220 can allow access to the interior of the underfloor storage vault 200. The hatchway may have a hatch (not shown) that may fit into an indention along the top surface of the hatchway 223 so that the hatch is flush with the top surface of the hatchway 223.

One or more front mounting brackets 212 may be placed along the top panel. The placement of the one or more front mounting brackets 212 may allow for one or more hatchway brackets 214 to be affixed to the hatchway 220 so that one or more support beams (not shown) may be secured between them. The one or more support beams may all allow for the underfloor storage vault 200 to be secured and mounted in a larger structure such as a house or an office building. Other examples may include one or more support beams secured between front mounting brackets 212 or secured between hatchway brackets 214. Any combination of front mounting brackets 212 and/or hatchway brackets 214 may be affixed to the underfloor storage vault 200 in various locations to allow for the underfloor storage vault 200 to be properly secured.

In one or more examples, the suspension brackets 215 are hardened loops affixed to the outer surface of the underfloor storage vault 200. The hardened loops allow for a tether of some sort such as, but not limited to, chains, twin, rope, cable, line, strand, cord, string, or hawser may be secured to allow for the entire underfloor storage vault 200 to be hoisted and moved by a crane type device. Other examples include interchanging one or more hardened loops with braces, mounts, fasteners, mounting holes, screws, mounting studs, anchors, etc. All of the forgoing may be used by themselves or in some combination to hoist the underfloor storage vault 200 for movement.

FIG. 2C is a right-side view of an example of the underfloor storage vault. Side panels 208 may be affixed to one another along a side interface 209. One or more side panels 208 may be affixed to a base panel (not shown) along a base interface 217 and to a top panel 247 along a top interface 211. One or more hatchways 220 may be affixed to the top panel 247 along a hatchway interface 221 and the one or more hatchways 220 allow for access to the interior of the underfloor storage vault 200. One or more front mounting brackets 212 and one or more hatchway brackets 214 may be affixed to the underfloor storage vault 200 to allow for a support beam to be secured, allowing for the underfloor storage vault 200 to be suspended for mounting. There may be one or more suspension brackets 215 affixed to the underfloor storage vault 200 that allow for the underfloor storage vault 200 to be hoisted by a tether or cable of some sort.

On the hatchway 220, the hatchway indention 259 may allow for the hatch 222 to be housed in the hatchway 220 such that the top surface of the hatch 220 is flush with the top surface of the Hatchway 223. The handle 230 may be located in between the first handle aperture 226 and the second handle aperture 228 along the top surface of the hatch 220, allowing an individual to grasp and pull the hatch 220 away from the hatchway 220. In one example, hinges (not shown) may be affixed to the hatch 220 and hatchway 220 to direct the opening and closing of the hatch 220. In one example, on or more small air inlets 262 are positioned along a portion of the surface of the hatch pocket 239 to allow for air to move freely in and out of the interior compartment of the underfloor storage vault. Other examples do not include air inlets along a surface of the hatch pocket 239.

The top surface of the hatch 222 may have one or more hatch holes (not shown) which allow for a mounting fastener 224 to traverse through the hatch 222 and protrude out the other side. The entrance of the hatch holes 239 may be sunken into the top surface of the hatch 222 so that the top of the mounting fastener 224 may be shield from individuals using cutters to cut the top of the mounting fasteners 224 and gain unauthorized access to the interior of the underfloor storage vault.

The protruding end of the mounting fastener 224 may enter into a corresponding hatchway pocket (not shown) located on a hatchway 220. By housing the hatch 222 in an indention 259 along the rim of the hatch 222 so that the top surface of the hatch 222 is flush with the top surface of the hatchway 223, the mounting fasteners 224 may secure the hatch 222 to the hatchway so that the hatchway aperture (not shown) is at least partially or completely covered.

In one example, the mounting fasteners 224 may have a specialized receiving pocket that only allows for a special insertion tool (not shown) with a matching insertion end to be inserted into the receiving pocket of the mounting fastener 224. Only the insertion tool with the matching insertion end may be properly seated in the receiving pocket on the mounting fastener 224. Once inserted, the insertion tool may engage with the corresponding mounting fastener 224 to turn it which allows for the mounting fastener tool to be disengaged with the hatch hole and the hatchway pocket underneath.

Only an individual with the proper insertion tool that corresponds with the receiving pocket on the mounting fastener may be able to properly remove the fasteners and gain access to the internal compartment of the underfloor storage vault. Any attempt to engage the receiving pocket and seat a tool without a matching insertion end will not turn the mounting fastener. Once all mounting fasteners 224 have been disengaged from the hatch, the hatch may be unseated and removed from the indention on the hatchway 220, thereby allowing access to the interior compartment of the underfloor storage vault 200. Other examples include other types of mounting fasteners 224 that may not have a specialized receiving pocket, allowing for normal screwdrivers or other tools to properly engage with the mounting fasteners 224. In one or more examples, "U" bars, hooks or loops may be affixed to the hatch 222 and hatchway 220 which allow for other types locking mechanisms to be utilized such as combination locks, key locks and/or chains.

FIG. 2D is a rear view of an example of the underfloor storage vault 200. Side panels 208 may be affixed to one another along a side interface 209. One or more side panels 208 may be affixed to a base panel 216 along a base interface 217 and to a top panel (not shown) along a top interface 211. One or more hatchways 220 may be affixed to the top panel along a hatchway interface and the one or more hatchways 220 allow for access to the interior of the underfloor storage vault 200. One or more front mounting brackets 212 and one or more hatchway brackets 214 may be affixed to the underfloor storage vault 200 to allow for a support beam to be secured, allowing for the underfloor storage vault 200 to be suspended for mounting. There may be one or more suspension brackets 215 affixed to the underfloor storage vault 200 that allow for the underfloor storage vault 200 to be hoisted by a tether or cable of some sort.

The hatchway 200 may house a hatch (not shown) in an indention (not shown) that allows for the top surface of the hatch to be flush with the top surface of the hatchway (not shown). The hatch may be secured to the hatchway 220 with specialized fasteners (not shown) and may have a handle (not shown) that allows for the hatch to be removed from the hatchway 220 so that the interior of the underfloor storage vault 200 may be accessed.

While this disclosure has been particularly shown and described with reference to preferred examples, it will be understood by those skilled in the art that various changes in form and detail may be made therein without departing from the spirit and scope of the invention. The investors expect skilled artisans to employ such variations as appropriate, and the inventors intend the invention to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

While various examples in accordance with the principles disclosed herein have been described above, it should be understood that they have been presented by way of example only, and not limitation. Thus, the breadth and scope of this disclosure should not be limited by any of the above-described exemplary examples but should be defined only in accordance with any claims and their equivalents issuing from this disclosure. Furthermore, the above advantages and features are provided in described examples but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, and by way of example, although the headings refer to a "Technical Field," the claims should not be limited by the language chosen under this heading to describe the so-called filed. Further, a description of a technology as background information is not to be construed as an admission that certain technology is prior art to any examples) in this disclosure. Neither is the "Brief Summary" to be considered as a characterization of the example(s) set forth in issued claims. Furthermore, any reference in this disclosure to "invention" in the singular should not be used to argue that there is only a single point of novelty in this disclosure. Multiple examples may be set forth according to the limitations of the multiple claims issuing from this disclosure, and such claims accordingly define the example(s), and their equivalents, that are protected thereby. In all instances, the scope of such claims shall be considered on their own merits in light of this disclosure but should not be constrained by the headings set forth herein.

I claim:

1. An underfloor storage vault comprising:

two or more side panels, each comprising a top edge, a base edge, and two side edges, wherein each of the side panels are affixed to one another along a side edge interface;

one or more base panels affixed to one or more of the side panels along a horizontal base edge interface of the side panels, wherein the two or more side panels are not parallel to the one or more base panels;

two or more angled panels, each comprising a hatchway edge, a bottom edge, and angled side edges, wherein the two or more angled panels are affixed to one another along an angled side edge interface and affixed along their bottom edge to one or more of the side panels along a horizontal top edge interface of the side panels;

a hatchway having a hatchway aperture sized for traversal through the hatchway by a user, wherein the hatchway is affixed to two or more of the angled panels along a hatchway edge interface;

the two or more side panels, one or more base panels, two or more angled panels, and the hatchway are arranged to form a container, wherein the hatchway aperture is sized for access by the user to the interior of the container;

one or more brackets configured to suspend the underfloor storage vault, wherein the one or more brackets are affixed to the underfloor storage vault proximate the hatchway; and the hatchway is configured to house a hatch, wherein the hatch at least partially covers the hatchway aperture when housed in the hatchway, and wherein the hatch may be removed to at least partially expose the hatchway aperture.

2. The underfloor storage vault of claim 1, further comprising:

one or more mounting fasteners;

the hatchway having one or more hatchway pockets, wherein the hatchway pockets are configured to receive a corresponding mounting fastener; and the hatch having one or more hatch holes, wherein the one or more mounting fasteners traverse through the corresponding one or more hatch holes and penetrate corresponding ones of the one or more hatchway pockets to secure the hatch to the hatchway.

3. The underfloor storage vault of claim 2, wherein each mounting fastener further comprises a specialized receiving pocket, wherein each specialized receiving pocket is configured to only engage a specialized matching insertion tool.

4. The underfloor storage vault of claim 2, wherein the hatch holes are sunken into a top surface of the hatch so that no portion of the mounting fasteners protrudes above the top surface of the hatch when the mounting fasteners have traversed through the hatch holes.

5. The underfloor storage vault of claim 1, further comprising:

the hatch having a first aperture and a second aperture, wherein the first aperture and the second aperture are located on a top surface of the hatch; and the hatch having a handle, wherein the handle is located in between the first aperture and second aperture on the top surface of the hatch.

6. The underfloor storage vault of claim 5, further comprising:

the hatch having a hatch pocket, wherein the first aperture and second aperture allow access to the hatch pocket; and the hatch pocket having one or more air inlets, wherein the air inlets allow air to enter and exit the underfloor storage vault when the hatch is housed in the hatchway.

7. The underfloor storage vault of claim 1, further comprising:

one or more members affixed to the underfloor storage vault for structural support of at least the side panels and the angled panels, each member selected from a group consisting of angled members, horizontal members, and vertical members.

8. The underfloor storage vault of claim 1, further comprising:

one or more additional brackets affixed to the underfloor storage vault, wherein the one or more brackets and the one or more additional brackets are arranged so that support beams used to suspend the underfloor storage vault from the one or more brackets and support beams used to suspend the underfloor storage vault from the one or more additional brackets would be oriented nonparallel to each other.

9. The underfloor storage vault of claim 1, further comprising:

a ladder having one or more ladder rungs, wherein a top end of the ladder is affixed to a bottom surface of the hatchway and a bottom end of the ladder is affixed to at least one of the one or more base panel.

10. An underfloor storage vault comprising:

one or more side panels, each comprising a top edge, a base edge, and two side edges;

one or more base panels, wherein the one or more base panels are affixed to the one or more side panels along a horizontal base edge interface of the side panels;

one or more top panels, each comprising a hatchway edge, a bottom edge, and angled side edges, wherein the one or more top panels are affixed along their bottom edge to the one or more side panels along a horizontal top edge interface of the side panels;

one or more hatchways having one or more hatchway apertures, wherein the one or more hatchways are affixed to the one or more top panels along a hatchway edge interface;

the one or more side panels, one or more base panels, one or more top panels and the one or more hatchways are arranged to form a container, wherein the hatchway aperture is sized for access by a user to the interior of the container;

one or more brackets configured to suspend the underfloor storage vault, wherein the one or more brackets are affixed to the underfloor storage vault proximate the hatchway; and the hatchway is configured to house a hatch, wherein the hatch at least partially covers the hatchway aperture when housed in the hatchway, and wherein the hatch may be removed to at least partially expose the hatchway aperture.

11. The underfloor storage vault of claim 10, further comprising:

one or more mounting fasteners;

the hatchway having one or more hatchway pockets, wherein the hatchway pockets are configured to receive a corresponding mounting fastener; and the hatch having one or more hatch holes, wherein the one or more mounting fasteners traverse through corresponding ones of the one or more hatch holes and penetrate corresponding ones of the one or more hatchway pockets to secure the hatch to the hatchway.

12. The underfloor storage vault of claim 11, wherein each mounting fastener further comprises a specialized receiving pocket, wherein the specialized receiving pocket is configured to only engage a specialized matching insertion tool.

13. The underfloor storage vault of claim 11, wherein the hatch holes are sunken into a top surface of the hatch so that no portion of the one or more mounting fasteners protrudes above the top surface of the hatch when the mounting fasteners have traversed through the hatch holes.

14. The underfloor storage vault of claim 10, further comprising:

the hatchway having an indention along an inter rim of a top surface of the hatchway, wherein the indention allows for theft hatch to be housed in the hatchway so that the top surface of the hatch is flush with the top surface of the hatchway.

15. The underfloor storage vault of claim 10, further comprising:

the hatch having a first aperture and a second aperture, wherein the first aperture and the second aperture are located on a top surface of the hatch; and the hatch having a handle, wherein the handle is located in between the first aperture and second aperture on the top surface of the hatch.

16. The underfloor storage vault of claim 15, further comprising:

the hatch having a hatch pocket, wherein the first aperture and second aperture allow access to the hatch pocket; and the hatch pocket having one or more air inlets, wherein the air inlets allow air to enter and exit the underfloor storage vault when the hatch is housed in the hatchway.

17. The underfloor storage vault of claim 10, further comprising:

one or more members affixed to the underfloor storage vault for structural support of at least the side panels and the top panels, each member selected from a group consisting of angled members, horizontal members, and vertical members.

18. The underfloor storage vault of claim 10 further comprising:

one or more additional brackets affixed to the underfloor storage vault, wherein the one or more brackets and the one or more additional brackets are arranged so that support beams used to suspend the underfloor storage vault from the one or more brackets and support beams used to suspend the underfloor storage vault from the one or more additional brackets would be oriented nonparallel to each other.

19. The underfloor storage vault of claim 10, further comprising:

a ladder having one or more ladder rungs, wherein a top end of the ladder is affixed to a bottom surface of the hatchway and a bottom end of the ladder is affixed to at least one of the one or more base panel.

20. An underfloor storage vault comprising:

four side panels, each comprising a top edge, a base edge, and two side edges, wherein each of the side panels is affixed to two other side panels along side edge interfaces;

one base panel affixed to the four side panels along a horizontal base edge interface of the side panels, wherein each one of the side panels is perpendicular to the base panel;

four angled panels, each comprising a hatchway edge, a bottom edge, and angled side edges, wherein each of the angled panels is affixed to two other angled panels along angled side edge interfaces and affixed to at least one of the side panels along horizontal top edge interfaces of the side panels;

a hatchway having a hatchway aperture sized for traversal through the hatchway by a user, wherein the hatchway is affixed to the angled panels along a hatchway edge interface;

the four side panels, one base panels, four angled panels, and the hatchway are arranged to form a container, wherein the hatchway aperture is sized for access to the interior of the container by the user;

one or more brackets configured to suspend the underfloor storage vault, wherein the one or more brackets are affixed to the underfloor storage vault proximate the hatchway;

the hatchway is configured to house a hatch, wherein the hatch at least partially covers the hatchway aperture when housed in the hatchway, and wherein the hatch may be removed to at least partially expose the hatchway aperture;

one or more mounting fasteners;

the hatchway having one or more hatchway pockets, wherein the hatchway pockets are configured to receive a corresponding mounting fastener;

the hatch having one or more hatch holes, wherein the one or more mounting fastener traverse through corresponding ones of the one or more hatch holes and penetrate corresponding ones of the one or more hatchway pockets to secure the hatch to the hatchway;

each mounting fastener having a specialized receiving pocket, wherein each specialized receiving pocket is configured to only engage a specialized matching insertion tool;

the hatch holes are sunken into the top surface of the hatch so that no portion of the mounting fasteners protrudes above a top surface of the hatch when the mounting fasteners have traversed through the hatch holes;

the hatchway having an indention along an inter rim of the top surface of the hatchway, wherein the indention allows for the hatch to be housed in the hatchway so that a top surface of the hatch is flush with the top surface of the hatchway;

the hatch having a first aperture and a second aperture, wherein the first aperture and the second aperture are located on the top surface of the hatch;

the hatch having a handle, wherein the handle is located in between the first aperture and second aperture on the top surface of the hatch;

the hatch having a hatch pocket, wherein the first aperture and second aperture allow access to the hatch pocket;

the hatch pocket having one or more air inlets, wherein the air inlets allow air to enter and exit the underfloor storage vault when the hatch is housed in the hatchway;

one or more members affixed to the underfloor storage vault for structural support of at least the side panels and the angled panels, each member selected from a group consisting of angled members, horizontal members, and vertical members;

one or more additional brackets affixed to the underfloor storage vault, wherein the one or more brackets and the one or more additional brackets are arranged so that support beams used to suspend the underfloor storage vault from the one or more brackets and support beams used to suspend the underfloor storage vault from the one or more additional brackets would be oriented nonparallel to each other; and a ladder having one or more ladder rungs, wherein a top end of the ladder is affixed to a bottom surface of the hatchway and a bottom end of the ladder is affixed to the base panel.

* * * * *